US007604327B2

(12) United States Patent
Sugahara

(10) Patent No.: US 7,604,327 B2
(45) Date of Patent: Oct. 20, 2009

(54) LIQUID EJECTION APPARATUS AND METHOD FOR CONTROLLING LIQUID EJECTION APPARATUS

(75) Inventor: Hiroto Sugahara, Ama-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 392 days.

(21) Appl. No.: 11/232,983

(22) Filed: Sep. 23, 2005

(65) Prior Publication Data

US 2006/0066652 A1 Mar. 30, 2006

(30) Foreign Application Priority Data

Sep. 24, 2004 (JP) ..... 2004-277722

(51) Int. Cl.
*B41J 2/05* (2006.01)

(52) U.S. Cl. ..... 347/56; 347/7; 347/89

(58) Field of Classification Search ..... 347/7, 347/56, 89, 86, 47
See application file for complete search history.

(56) References Cited

U.S. PATENT DOCUMENTS 5,097,275 A * 3/1992 Takita ..... 347/56
5,231,424 A * 7/1993 Kaneko et al. ..... 347/29
5,682,190 A * 10/1997 Hirosawa et al. ..... 347/94
5,818,485 A * 10/1998 Rezanka ..... 347/89
6,000,792 A * 12/1999 Koizumi et al. ..... 347/89
6,074,033 A * 6/2000 Sayama et al. ..... 347/10
6,428,156 B1 * 8/2002 Waller et al. ..... 347/89
6,705,704 B2 3/2004 Harvey et al.
2004/0125189 A1 7/2004 Kuki et al.

FOREIGN PATENT DOCUMENTS

JP 2003-505281 2/2003
JP 2004-142450 5/2004
WO WO 01/08888 2/2001

* cited by examiner

*Primary Examiner*—Lam S Nguyen
(74) *Attorney, Agent, or Firm*—Banner & Witcoff, Ltd.

(57) ABSTRACT

An ink jet printer as an liquid ejection apparatus includes two ink channels which are independent from each other and communicate an ink tank and a pressure chamber communicating with a nozzle, a pump pressurizing ink in one of the ink channels, and a mode switching section capable of switching between two modes of ink ejection mode and ink circulation mode. In the ink ejection mode, ink is provided from the ink tank to the pressure chamber to the pressure chamber through the two ink channels, so that the ink is ejected through the nozzle. In the ink circulation mode, the pump pressurizes ink in one of the ink channels, so that the ink is forcibly circulated between the ink tank and the pressure chamber. The liquid ejection apparatus is capable of reliably discharging air bubbles remaining in the ink by ejecting a minimum amount of liquid through the nozzle.

9 Claims, 19 Drawing Sheets

LIQUID EJECTION APPARATUS AND METHOD FOR CONTROLLING LIQUID EJECTION APPARATUS

FIELD OF THE INVENTION

The present invention relates to a liquid ejection apparatus and a method for controlling a liquid ejection apparatus.

BACKGROUND OF THE INVENTION

In a liquid ejection apparatus which ejects liquid through its nozzles by applying pressure on the liquid such as an ink jet printer which ejects ink, air bubbles may enter or be mixed in the liquid channels communicating with the nozzles. The mixed bubbles absorb part of the pressure to be applied on the liquid. This may prevent the liquid from being ejected normally through the nozzles. Therefore, it is necessary to completely discharge the air bubbles mixed in the liquid channels. For example, a structure for a purging operation is used widely in the field of ink jet printers and includes a purge cap and a purge pump. The purge cap covers the ejection ports of the nozzles and is connected to the purge pump. In this structure, while the purge pump is pumping liquid out of the nozzles, air bubbles are discharged. Such a structure is shown in FIG. 2 of U.S. Patent Application Publication No. US 2004/125189 A1 corresponding to Japanese Patent Application Laid-open No. 2004-142450, for example. FIGS. 1 and 2C of PCT International Publication No. WO 01/08888A1 (corresponding to Published Japanese Translation of PCT International Publication for Patent Application No. 2003-505281 and U.S. Pat. No. 6,705,704 B2) show a liquid ejection apparatus for ejecting liquid from chambers (pressure chambers) through nozzles by varying the volume of the chambers while circulating liquid continuously between the chambers and a liquid supply source by aid of a pump or the like.

In many cases, such liquid channels are complex or complicated in shape, and thus the air bubbles mixed in them are liable to remain in the corners of the liquid channels. Therefore, when liquid is pumped from nozzles, as disclosed in U.S. Patent Application Publication No. US2004/125189 A1, it is necessary to perform a number of purging operations, with the result that liquid is wasted. The liquid ejection apparatus disclosed in WO 01/08888A1 circulates liquid continuously through the liquid channels. If the liquid is circulated under high pressure, the nozzle menisci may be broken, and thus liquid may leak from the nozzles the ejection through which is not programmed to do so. If the liquid is circulated under low pressure, it is not possible to reliably discharge the air bubbles in the liquid channels.

SUMMARY OF THE INVENTION

An object of the present invention is to provide a liquid ejection apparatus which can reliably discharge air bubbles by ejecting a minimum amount of liquid through its nozzle. Another object of the invention is to provide a method of controlling such a liquid ejection apparatus.

According to a first aspect of the present invention, there is provided a liquid ejection apparatus comprising: a plurality of nozzles through which liquid is ejected; a plurality of pressure chambers each communicating with one of the nozzles; an actuator which applies pressure selectively to liquid in the pressure chambers to eject the liquid through the nozzles; a first liquid channel and a second liquid channel independent of the first liquid channel, the first and second liquid channels communicating the pressure chambers with a liquid supply source; a pressure applying unit which applies pressure to liquid in the first liquid channel; and a mode switching unit which switches between two modes of a liquid ejection mode in which liquid is supplied from the liquid supply source through the first and second liquid channels to the pressure chambers to be ejected through the nozzles; and a liquid circulation mode in which the pressure applying unit applies pressure to the liquid in the first liquid channel to circulate the liquid between the liquid supply source and each of the pressure chambers.

The actuator applies pressure selectively on the liquid in one or more of the pressure chambers to eject liquid through the associated nozzle or nozzles (the liquid ejection mode). The pressure applying unit pressurizes the liquid in the first liquid channel to circulate liquid between the liquid supply source and each of the pressure chambers through the two liquid channels (the liquid circulation mode). The mode switching unit is capable of switching the liquid ejection mode and the liquid circulation mode.

When liquid is ejected through one or more of the nozzles onto an object, the liquid ejection mode is maintained. If air bubbles are mixed in the liquid channels, and when the mixed bubbles need to be discharged, the modes can be switched from the liquid ejection mode to the liquid circulation mode, in which liquid is circulated between the liquid supply source and each of the pressure chambers. Thus, the modes are switched to the liquid circulation mode only when the need arises. This makes it possible to discharge air bubbles reliably from the pressure chambers, and to reduce the amount of liquid ejected through the nozzles while the bubbles are discharged.

The liquid ejection apparatus may be provided with a valve capable of closing the second liquid channel. The mode switching unit may be switchable among the two modes and a nozzle cleaning mode in which, after the valve closes the second liquid channel, the pressure applying unit applies pressure to the liquid in the first liquid channel to eject the liquid through the nozzles. In this case, the mode switching unit can switch the modes to the nozzle cleaning mode, in which liquid is ejected through the nozzles. This makes it possible to remove the air bubbles remaining between each of the pressure chambers and the associated nozzle, and to eliminate the clogging of the nozzles. As a result, it is possible to discharge air bubbles and eliminate nozzle clogging more effectively than in a case where only the liquid circulation mode is used.

After the mode switching unit switches the modes from the liquid ejection mode to the liquid circulation mode, the mode switching unit may further switch the modes to the nozzle cleaning mode. In this case, after the air bubbles in the liquid channels upstream of the pressure chambers are discharged in the liquid circulation mode, the modes are switched to the nozzle cleaning mode, in which the air bubbles between each of the pressure chambers and the associated nozzle are removed. This reduces the amount of liquid ejected in the nozzle cleaning mode.

The liquid ejection apparatus may further include guides each of which is provided in one of the pressure chambers. Each of the guides forces the liquid pressurized by the pressure applying unit and flowed from the first liquid channel into the associated pressure chamber to flow out of the pressure chamber to the second liquid channel. In the liquid circulation mode, each of the guides the liquid pressurized in the first liquid channel by the pressure applying unit, so that the pressurized liquid flows from the associated pressure chamber to the second liquid channel. This reduces the turbulent flow of liquid in the pressure chambers, so that the air bubbles in the chambers can be discharged stably toward the second liquid channel.

The guides may be partition walls each partitioning the associated pressure chamber into a first space and a second space, which communicate with the first and second liquid channels, respectively. Each of the pressure chambers may be connected to the associated nozzle by a communicating channel. The two spaces of each of the pressure chambers may be connected together only in the vicinity of the associated communicating channel. In this case, each pressure chamber is divided except for the vicinity of the associated communicating channel by the associated partition wall into the first and second spaces, which communicate with the first and second liquid channels, respectively. This enables the liquid pressurized in the first liquid channel by the pressure applying unit and flowed into the pressure chambers to flow out more reliably to the second liquid channel. In addition, this can accelerate the liquid flow near the edges of the pressure chambers and enables the air bubbles existing near the edges to flow stably to the second liquid channel.

The actuator may be a piezoelectric actuator, which includes a vibration plate and a piezoelectric layer. The vibration plate may be arranged to cover the pressure chambers and may be spaced from the partition walls to form a gap therebetween. The piezoelectric layer may be disposed on a surface of the vibration plate which is opposite to the pressure chambers. The actuator deforms the piezoelectric layer (and the vibration plate) to apply pressure on the liquid in the pressure chambers. Because the vibration plate is spaced from the partition walls to form a gap therebetween, the walls do not prevent the deformation of the piezoelectric layer and vibration plate. This makes it possible to apply pressure efficiently on the liquid in the pressure chambers.

Each of the first and second liquid channels may include a common liquid chamber and individual channels. The common liquid chamber communicates with the pressure chambers. Each of the individual channels connects the common liquid chamber and one of the pressure chambers. The liquid supplied from the liquid supply source to the two common liquid chambers of the liquid channels flows to the pressure chambers through the individual channels, which branch off from the common liquid chambers.

The liquid ejection apparatus may further include a liquid ejection head, which has the nozzles, the pressure chambers and the actuator. In the liquid ejection head, one of the common liquid chambers of the two liquid channels is positioned over the other of the common liquid chambers. This results in the common liquid chambers occupying a smaller area, making the liquid ejection apparatus smaller in size.

According to a second aspect of the present invention, there is provided a liquid ejection apparatus comprising: a nozzle through which liquid is ejected; a pressure chamber communicating with the nozzle and having a first supply port and a second supply port; a first channel connecting the first supply port to a liquid supply source; a second channel connecting the second supply port to the liquid supply source; an actuator which applies pressure to liquid in the pressure chamber to eject the liquid through the nozzle, wherein the pressure chamber is supplied with the liquid from the liquid supply source through the first and second channels when the actuator is operated; and a pressure regulator which regulates the pressure of the liquid flowing through one of the first and second channels so that liquid is supplied to the pressure chamber through the first channel and that the liquid is discharged from the pressure chamber through the second channel.

This liquid ejection apparatus ejects liquid when the actuator is operated. The actuator operation varies the pressure in the pressure chamber, so that the pressure chamber can be supplied with liquid from the liquid supply source through the first and second channels (the liquid flows in the same direction through the two channels). In order to remove air bubbles from the pressure chamber and the channel between the pressure chamber and the nozzle, the pressure regulator can apply positive or negative pressure to the liquid flowing through the first or second channel. The pressure application causes liquid to be supplied through the first channel to the pressure chamber and discharged from the chamber through the second channel (the liquid flows in opposite directions through the two channels). When the liquid is ejected through the nozzle, the pressure chamber is supplied with the liquid from the liquid supply source through the two channels, and the pressure of the liquid flowing through the first or second channel can be regulated so that the liquid is circulated through the two channels between the liquid supply source and the pressure chamber. By forcing the circulated liquid to flow in or through the pressure chamber, it is possible to remove air bubbles effectively from the chamber.

This liquid ejection apparatus may further be provided with a guide in the pressure chamber. The guide guides the liquid from the first supply port to the second supply port. The apparatus may further be provided with a control unit which controls the pressure regulator. The apparatus may further be provided with a valve which closes the second channel by being controlled by the control unit. The control unit controls the pressure regulator and the valve so that, when the nozzle is cleaned, the pressure chamber is supplied with the liquid through the first supply port and the second channel is closed.

According to a third aspect of the present invention, there is provided a method for controlling a liquid ejection apparatus, the apparatus having a nozzle and a pressure chamber communicating with the nozzle, the pressure chamber having a first supply port and a second supply port, the apparatus including an actuator which applies pressure to liquid in the pressure chamber to eject liquid through the nozzle, the method comprising: supplying liquid to the pressure chamber through the first and second supply ports by driving the actuator; and supplying liquid to the pressure chamber through the first supply port while discharging the liquid from the pressure chamber through the second supply port.

According to this controlling method, when ejecting liquid, it is possible to supply the pressure chamber with liquid through the two supply ports. According to the method, when removing air bubbles from the liquid in the pressure chamber, it is possible to supply liquid to the chamber through the first supply port and discharge the liquid from the pressure chamber through the second supply port. Thus, by making the second supply port of the pressure chamber function selectively as an inlet or an outlet, it is possible to remove air bubbles effectively from the liquid in the pressure chamber with a simple structure.

This liquid ejection apparatus may further have a liquid tank, a first channel communicating the liquid tank and the first supply port together, and a second channel communicating the liquid tank and the second supply port together. Liquid may be circulated between the liquid tank and the pressure chamber through the first and second channels while the liquid is discharged from the pressure chamber through the second supply port. The actuator does not need to be driven while the liquid is discharged from the pressure chamber through the second supply port. In order to effectively remove liquid that contains air bubbles from the nozzle, liquid may be supplied to the pressure chamber through the first channel and closing the second channel.

DETAILED DESCRIPTION OF PREFERRED EMBODIMENTS

Figure 1:
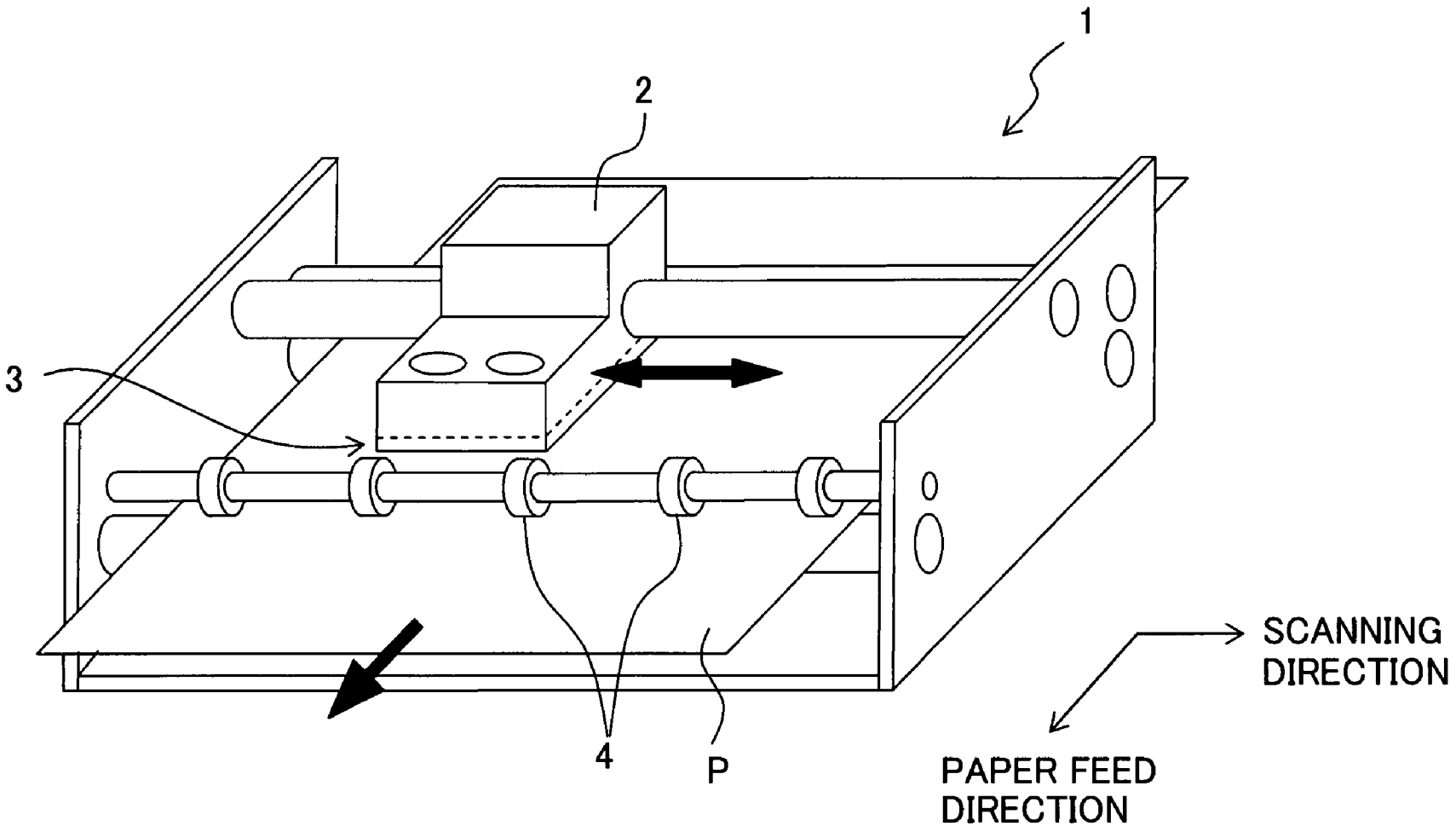
FIG. 1 is a schematic perspective view of an ink jet printer according to a first embodiment of the present invention.

A first embodiment of the present invention will be described below. This embodiment is an ink jet printer for ejecting ink through its nozzles onto recording paper as an example of the present invention. As shown in FIG. 1, the ink jet printer 1 (liquid ejection apparatus) is fitted with a carriage 2, which can move right and left in FIG. 1. The carriage 2 carries a serial ink jet head 3 (liquid ejection head), which ejects ink onto recording paper P. The printer 1 is also fitted with feed rollers 4, which feed recording paper P forward in FIG. 1. The printer 1 is further fitted with a controller 5 (see FIG. 10), which controls the whole of the printer 1. The ink jet head 3 has nozzles 20 (see FIGS. 3-9) formed on its bottom surface. The ink jet head 3 moves right and left (in the scanning direction) with the carriage 2 and ejects ink through the ejection ports of the nozzles 20 onto the recording paper P being fed. The recording paper P on which an image or the like has been recorded by the ink jet head 3 is discharged forward (in the paper feed direction) by the feed rollers 4.

Figure 2:
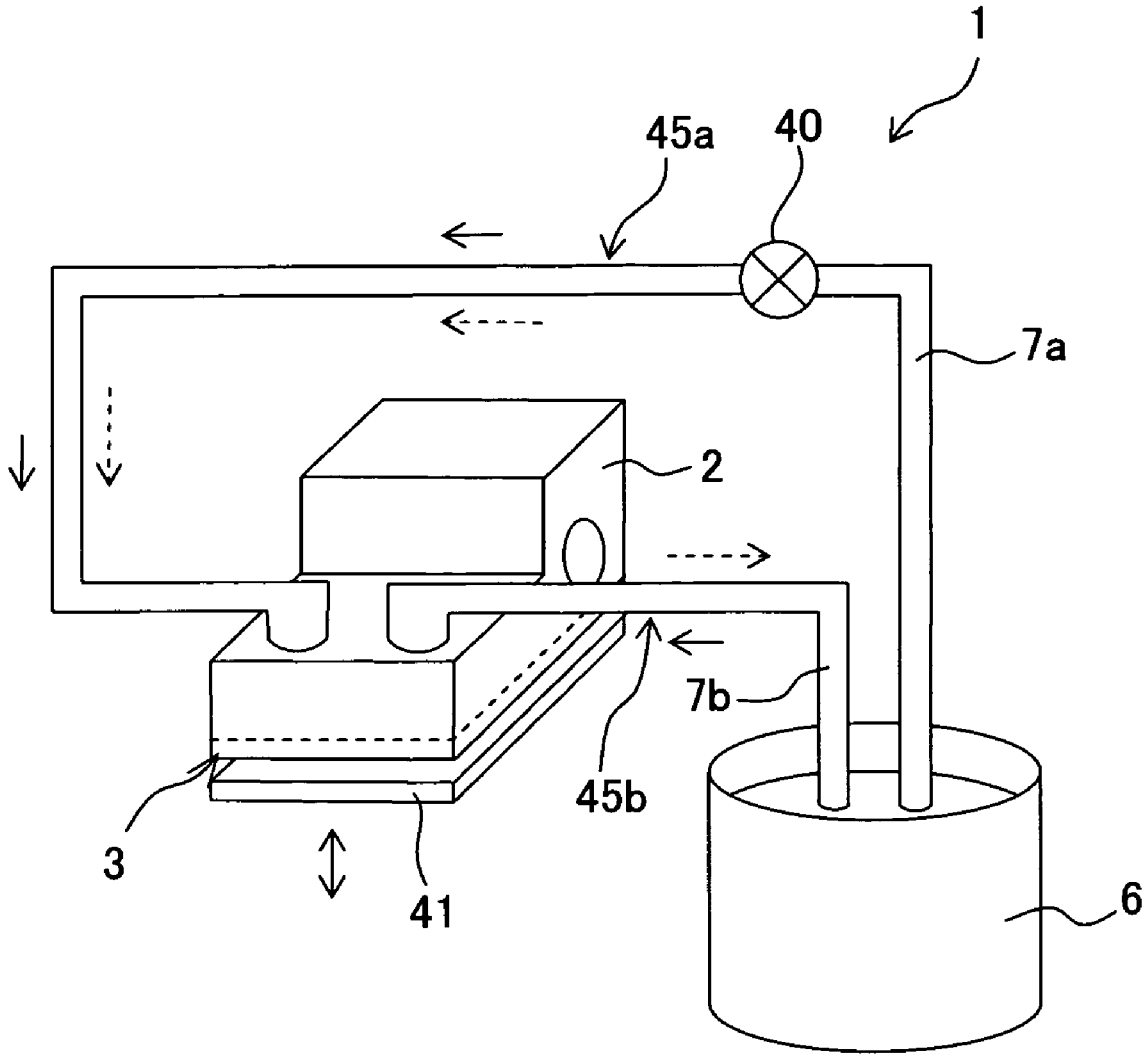
FIG. 2 is a schematic diagram of an ink supply system of the ink jet printer.

As shown in FIG. 2, the ink jet head 3 is connected to an ink tank 6 (ink supply source) via two tubes 7*a* and 7*b*. The tube 7*a* is provided with a pump 40 (pressurizing unit or pressure regulator). A maintenance operation for discharging the air bubbles in the ink jet head 3 includes the step of moving the head 3 to a maintenance position, where the bottom surface of the head 3 does not face recording paper P, at one end of the ink jet printer 1 in the scanning directions. The moving step is followed by the step of circulating ink between the ink tank 6 and ink jet head 3 by the pump 40. The maintenance operation will be described later on in detail.

The ink jet head 3 will be described below. As shown in FIGS. 3-9, the ink jet head 3 includes channel units 8 and a piezoelectric actuator 9, which is disposed on the top surfaces of the ink channel units. The channel unit 8 has ink channels formed therein, which include nozzles 20 and pressure chambers 16.

The channel unit 8 will be described. As shown in FIGS. 4-9, the channel unit 8 includes a cavity plate 10, a base plate 11, manifold plates 12-14 and a nozzle plate 15, which are bonded together in the form of a laminate. The cavity plate 10, base plate 11 and manifold plates 12-14 are stainless steel plates. The ink channels can be etched easily through the five plates 10-14 to form therein pressure chambers 16 and manifolds 17*a* and 17*b*, which will be described later on. The nozzle plate 15 may be formed of polyimide or another high-molecular synthetic resin and is bonded to the under surface of the bottom manifold plate 14. Alternatively, the nozzle plate 15 may be formed of stainless steel or another metallic material, as is the case with the other five plates 10-14.

Figure 3:
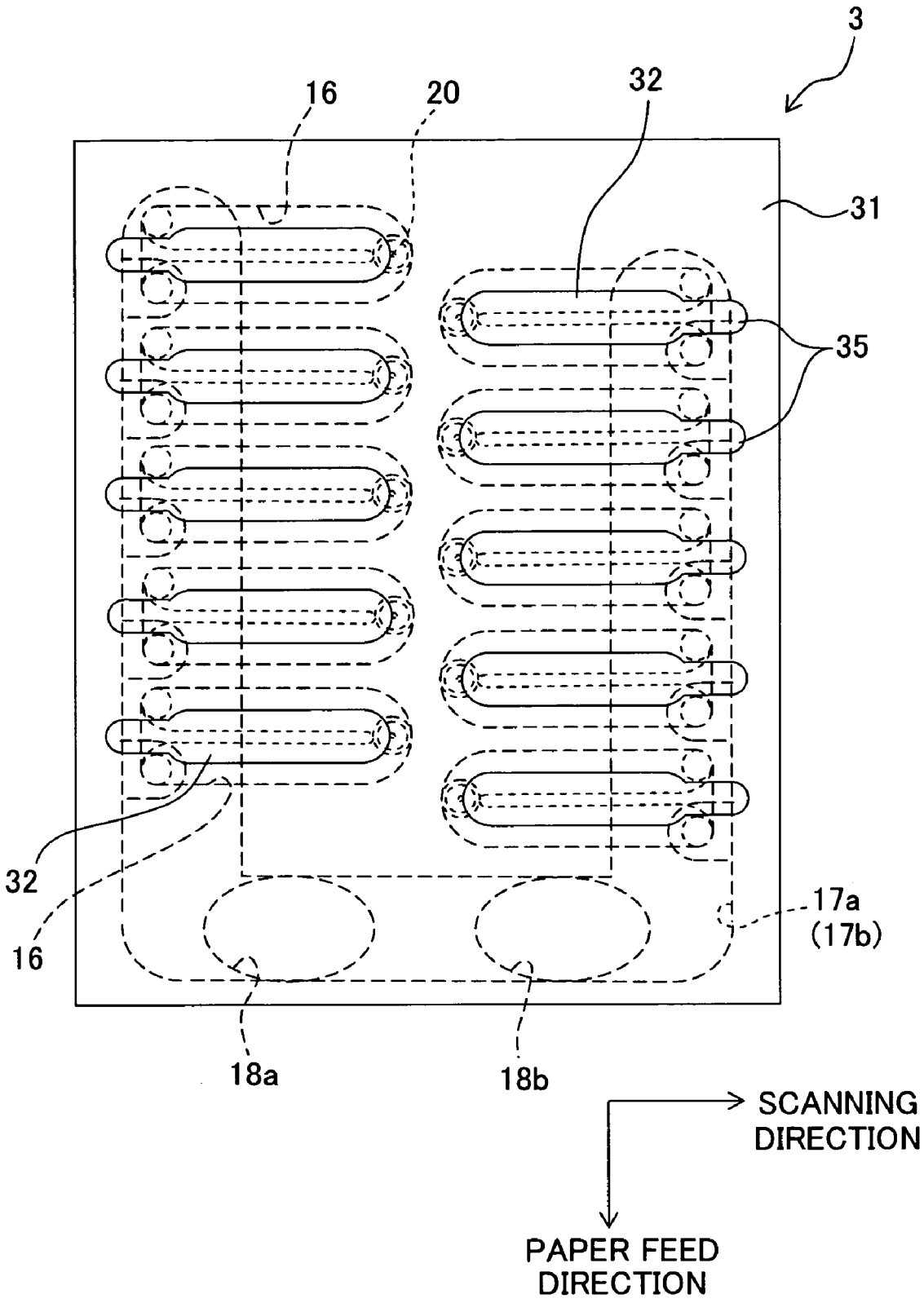
FIG. 3 is a plan view of an ink jet head of the ink jet printer.
Figure 4:
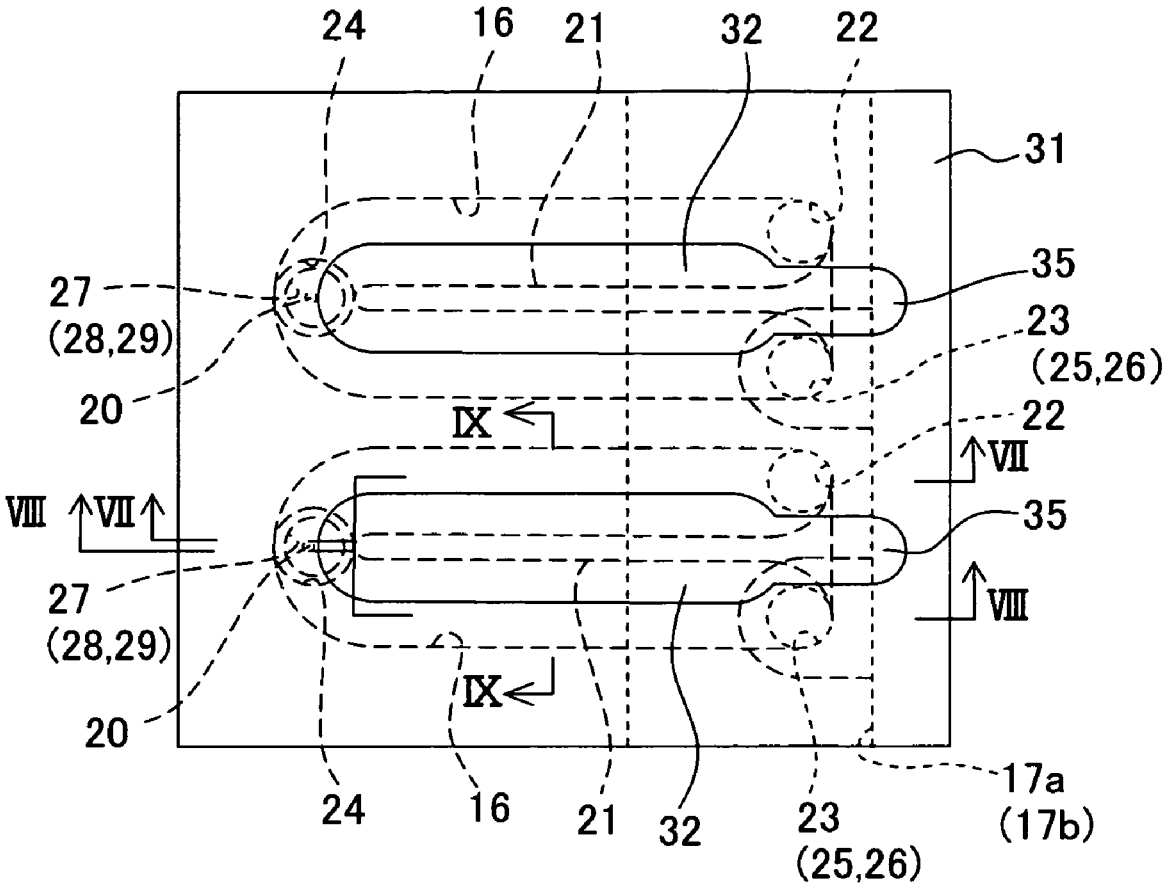
FIG. 4 is an enlarged plan view of part of the ink jet head.

As shown in FIG. 3, the cavity plate 10 has a number of pressure chambers 16 formed therethrough and arrayed along a plane. The pressure chambers 16 are open on the top side of the channel unit 8 (the upper surface of the cavity plate 10). A vibration plate 30, which will be described later on, is bonded or joined to the upper surface of the cavity plate 10. The pressure chambers 16 are arrayed in two rows extending in the paper feed direction (vertical direction in FIG. 3). The pressure chambers 16 extend in the scanning directions (right and left directions in FIG. 3) in a plan view. Each pressure chamber 16 is partitioned into two spaces 16*a* and 16*b* by a partition wall 21 extending in the longitudinal direction of the pressure chamber. The cavity plate 10 also has two ink supply ports 18*a* and 18*b* formed therethrough, which are connected to the ink tank 6.

The base plate 11 has pairs of communicating holes 22 and 23 formed therethrough. Each pair of communicating holes 22 and 23 is formed at a position overlapping with one end (the right end in FIGS. 3-6) of one of the pressure chambers 16. The communicating holes 22 and 23 of each pair are positioned to interpose the associated partition wall 21. The base plate 11 has other communicating holes 24 formed therethrough, each of which is formed at a position overlapping the other end (the left end in FIGS. 3-6) of one of the pressure chambers 16.

The top manifold plate 12 of the three laminated manifold plates 12-14 has a manifold 17*a* and communicating holes 25 formed therethrough. The manifold 17*a* communicates with the communicating holes 22 of the base plate 11 and has two portions extending in the paper feed direction. Each communicating hole 25 of this manifold plate 12 communicates with one of the communicating holes 23 of the base plate 11. The bottom manifold plate 14 has a manifold 17*b* formed therethrough, which communicates with the communicating holes 23 of the base plate 11 and has two portions extending in the paper feed direction. The intermediate manifold plate 13 has communicating holes 26 formed therethrough, each of which communicates with one of the communicating holes 25 of the top manifold plate 12, and which communicates with the lower manifold 17*b*. The two manifolds 17*a* and 17*b* are isolated from each other by the intermediate manifold plate 13. The manifold 17*a* is positioned over the manifold 17*b* so that the two manifolds occupy a smaller horizontal area, which results in the ink jet head 3 being smaller. The manifolds 17*a* and 17*b* can be supplied with ink through the ink supply ports 18*a* and 18*b*, respectively, from the ink tank 6. The top manifold plate 12 has communicating holes 27 formed therethrough. The intermediate manifold plate 13 has communicating holes 28 formed therethrough. The bottom manifold plate 14 has communicating holes 29 formed therethrough. Each of the communicating holes 24 of the base plate 11 is aligned vertically and communicates with one of the communicating holes 27, one of the communicating holes 28 and one of the communicating holes 29 of the manifold plates 12-14, at a position overlapping with an end of the pressure chamber 16 that is opposite to the manifold 17*a*, 17*b* in a plan view.

The nozzle plate 15 has nozzles 20 formed therethrough, each of which is formed at a position over lapping with one of the communicating holes 24 of the base plate 11 and the associated communicating holes 27-29 of the manifold plates 12-14 in a plan view. The nozzles 20 may be formed through a substrate of polyimide or another high-molecular synthetic resin by means of excimer laser processing. During a maintenance operation, a cap 41 (see FIG. 2) is put on the under surface of the nozzle plate 15 to cover the nozzles 20.

Figure 5:
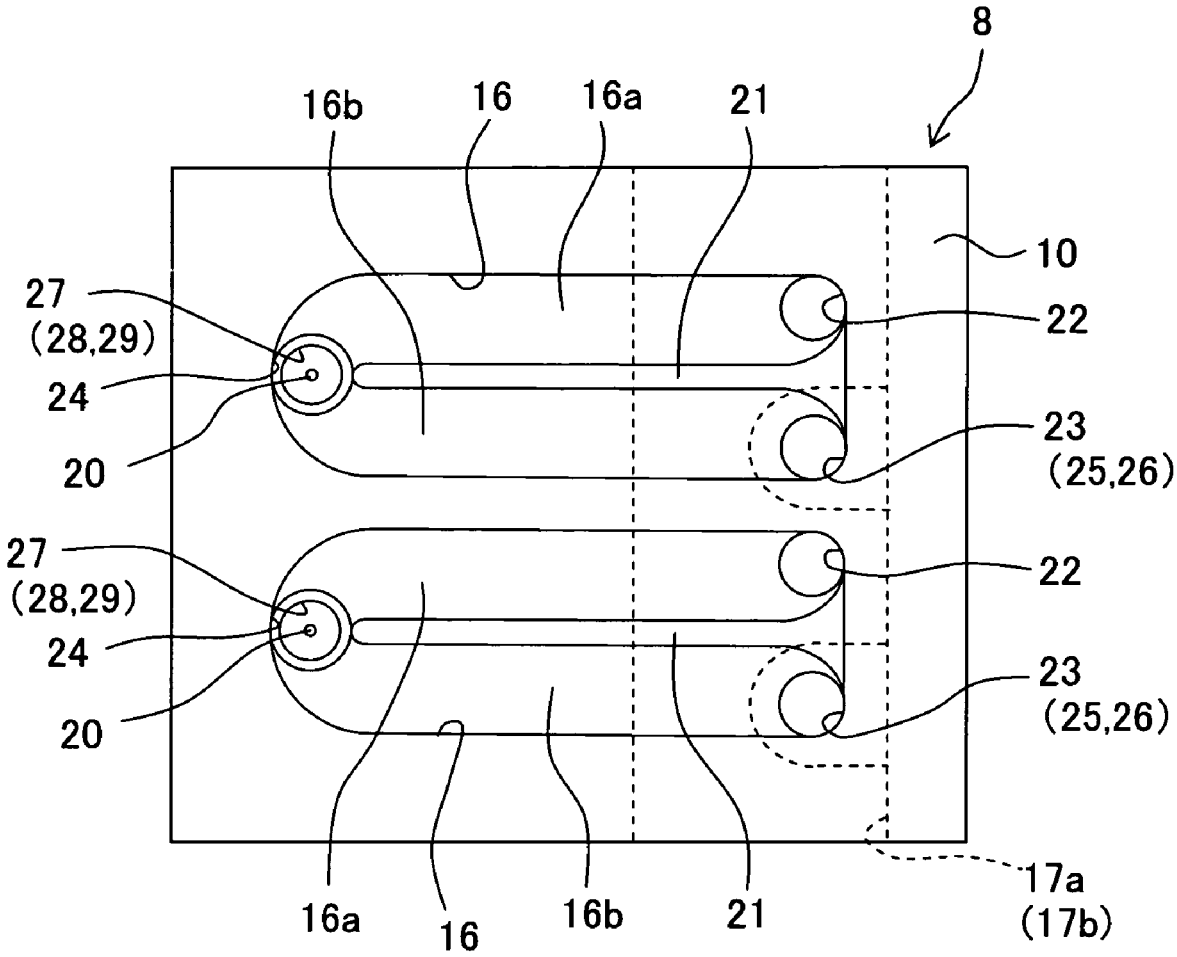
FIG. 5 is an enlarged plan view of part of a channel unit of the ink jet head.
Figure 6A:
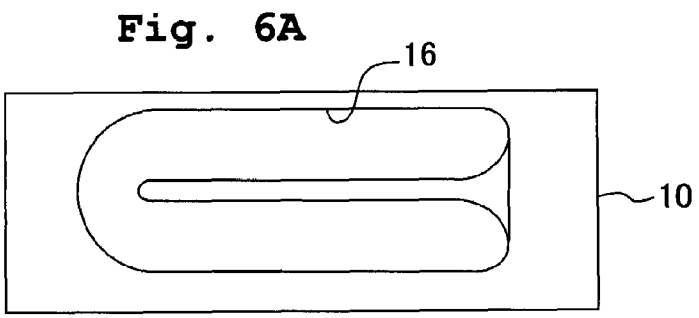
FIG. 6A is an enlarged plan view of part of a cavity plate of the channel unit.
Figure 6B:
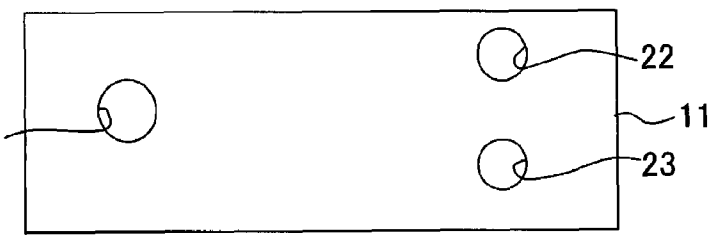
FIG. 6B is an enlarged plan view of part of the base plate of the channel unit.
Figure 6C:
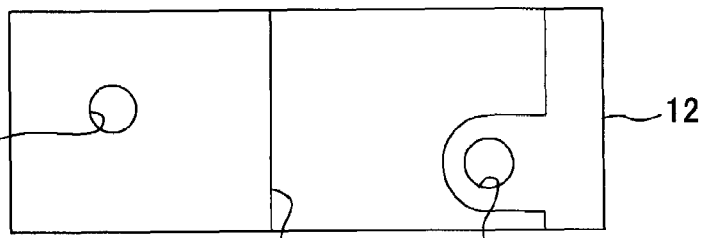
FIG. 6C is an enlarged plan view of part of the top manifold plate of the channel unit.
Figure 6D:
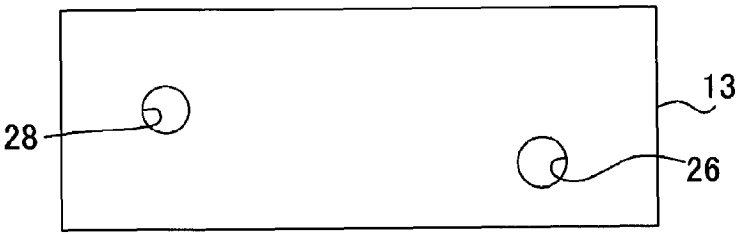
FIG. 6D is an enlarged plan view of part of the intermediate manifold plate of the channel unit.
Figure 6E:
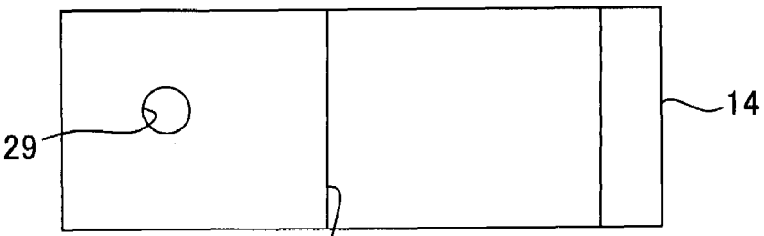
FIG. 6E is an enlarged plan view of part of the bottom manifold plate of the channel unit.
Figure 6F:
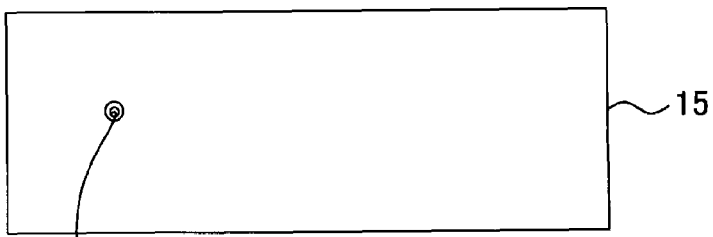
FIG. 6F is an enlarged plan view of part of a nozzle plate of the channel unit.
Figure 7:
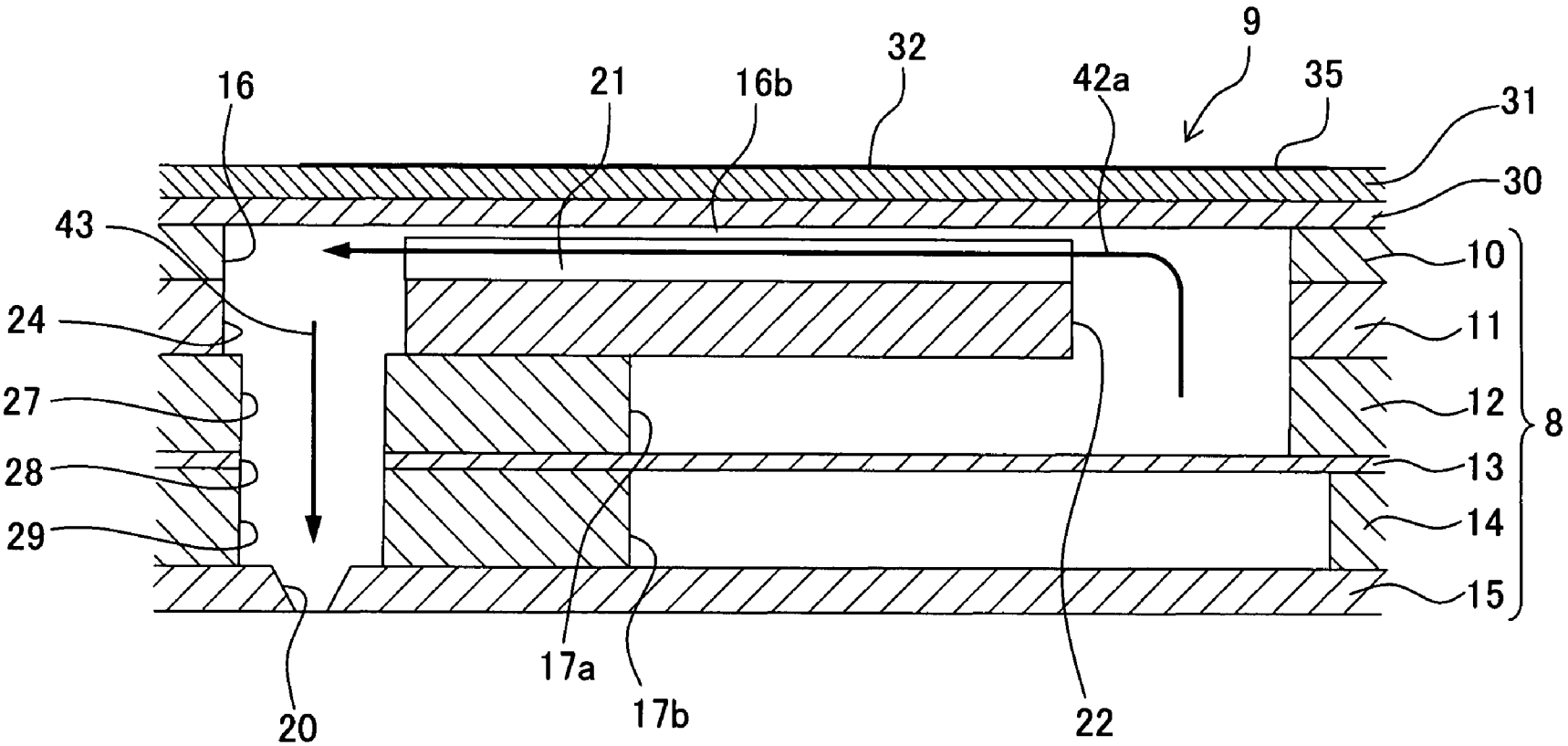
FIG. 7 is a sectional view taken along line VII-VII of FIG. 4.
Figure 8:
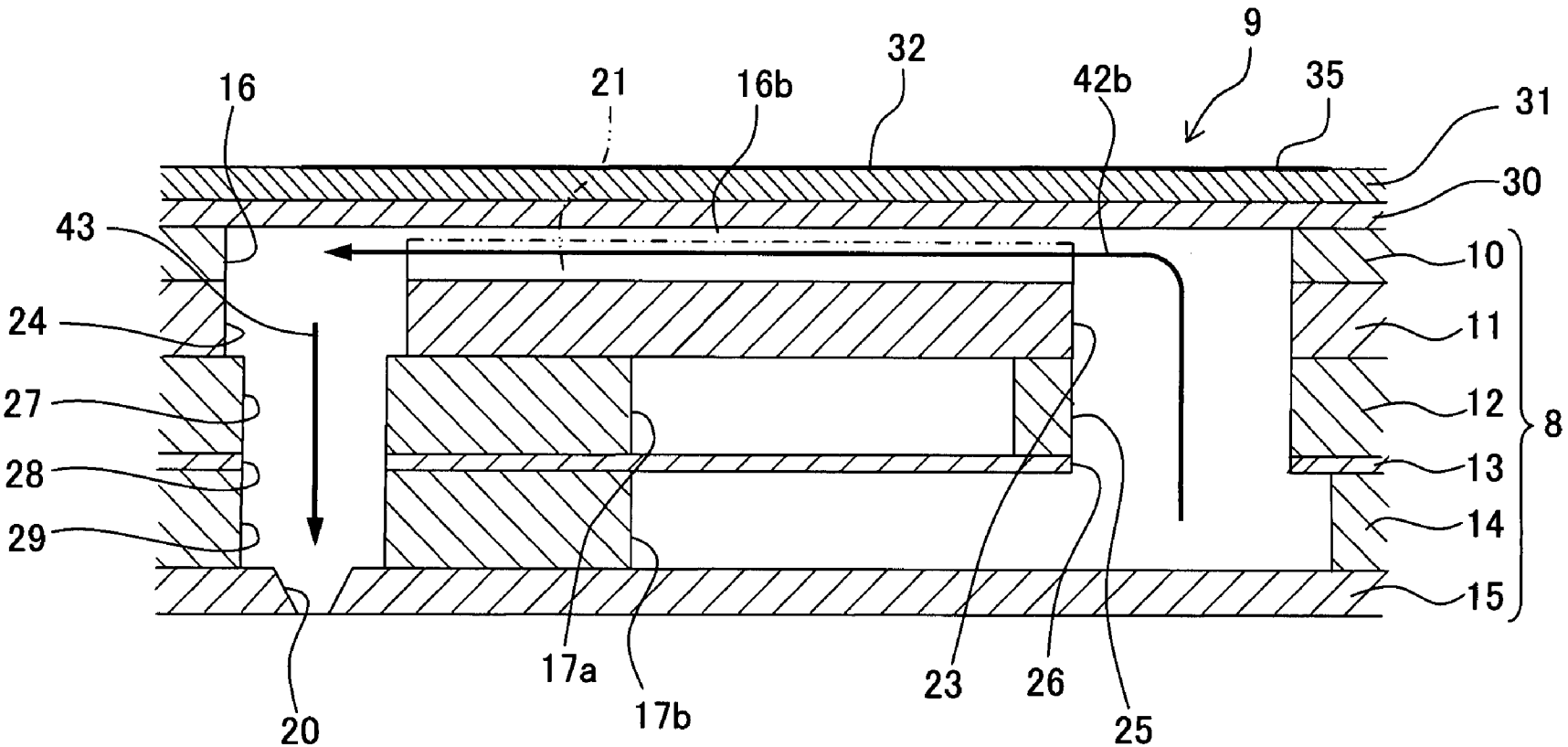
FIG. 8 is a sectional view taken along line VIII-VIII of FIG. 4.
Figure 9:
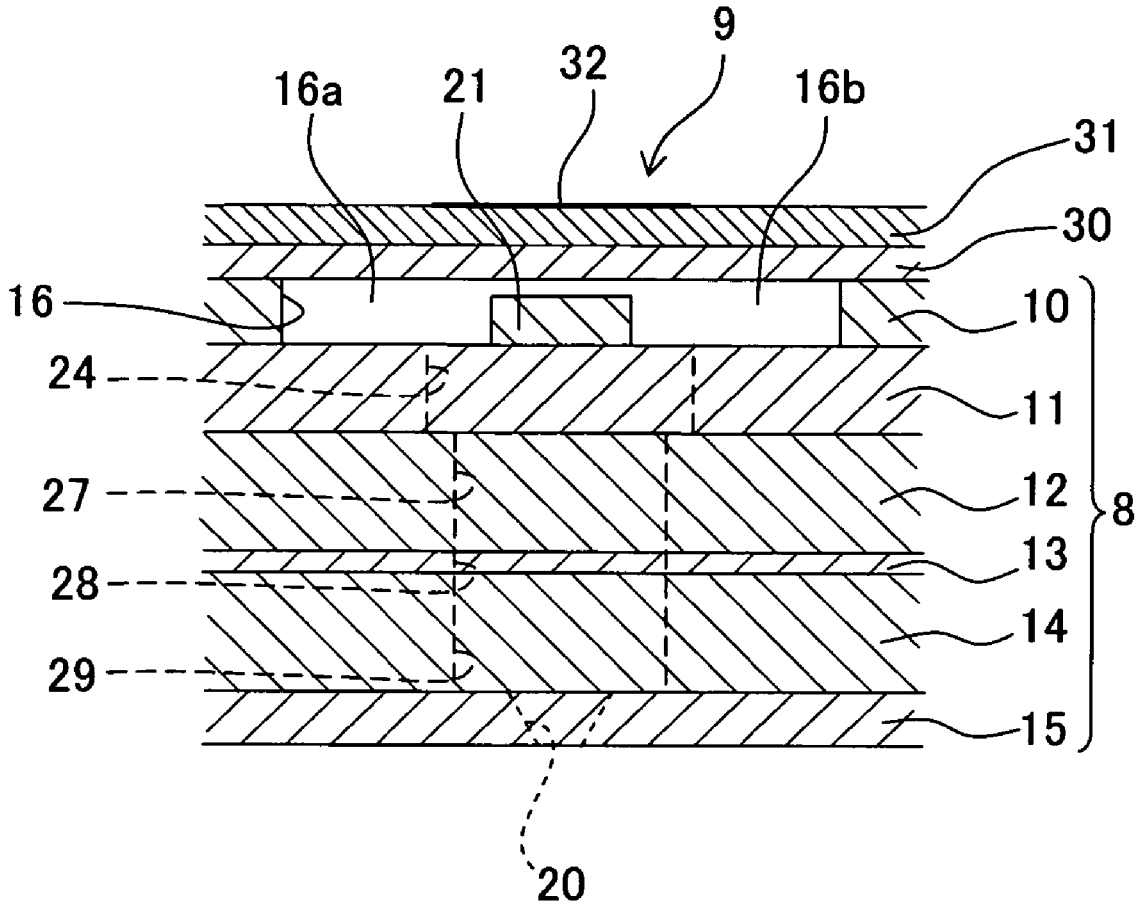
FIG. 9 is a sectional view taken along line IX-IX of FIG. 4.

The partition wall 21 formed in each pressure chamber 16 extends from the right end of the chamber in FIG. 5 to a position near the associated communicating hole 24 (communicating passage), which communicates with the associated nozzle 20. Each partition wall 21 partitions the associated pressure chamber 16 into a first space 16*a* and a second space 16*b*. The first space 16*a* communicates with the upper manifold 17*a* via the associated communicating hole 22 (individual channel). The second space 16*b* communicates with the lower manifold 17*b* via the associated communicating holes 23, 25 and 26 (individual channels). The spaces 16*a* and 16*b*, into which the partition wall 21 partitions the pressure chamber 16, are connected together only near the associated communicating hole 24 in plan view, which connects the associated pressure chamber 16 and nozzle 20. As shown in FIGS. 7-9, there is a gap between each partition wall 21 and the piezoelectric actuator 9, which covers the pressure chambers 16 and will be described later on. Accordingly, the partition walls 21 in the pressure chambers 16 do not prevent the vibration plate 30 of the piezoelectric actuator 9 from deforming. The gap between each partition wall 21 and the actuator 9 may not be larger than ⅕ of the height of the pressure chambers 16, and is not more than the amount in which the actuator 9 deforms.

As shown in FIG. 7, a first individual ink channel 42*a* is formed starting from the upper manifold 17*a* and arriving at the first space 16*a* of each pressure chamber 16 via the associated communicating hole 22. As shown in FIG. 8, a second individual ink channel 42*b* starts from the lower manifold 17*b* and arrives at the second space 16*b* of each pressure chamber 16 via the associated communicating holes 26, 25 and 23. Another ink channel 43 starts from the spaces 16*a* and 16*b* of each pressure chamber 16 and arrives at the associated nozzle 20 via the associated communicating holes 24, 27, 28 and 29. As shown in FIG. 2, the tube 7*a*, the ink supply port 18*a* (see FIG. 3) and all the first individual ink channels 42*a* construct a first ink channel 45*a* (liquid channel). Likewise, the tube 7*b*, the ink supply port 18*b* (see FIG. 3) and all the second individual ink channels 42*b* constructs a second ink channel 45*b*(liquid channel). The two ink channels 45*a* and 45*b* connect the ink tank 6 and pressure chambers 16 and are independent of each other.

The piezoelectric actuator 9 will be described below. As shown in FIGS. 4 and 7-9, the piezoelectric actuator 9 includes an electrically conductive vibration plate 30, a piezoelectric layer 31 and individual electrodes 32. The vibration plate 30 is disposed on the top surface of the channel unit 8. The piezoelectric layer 31 is formed on the upper surface of the vibration plate 30. The individual electrodes 32 are formed on the upper surface of the piezoelectric layer 31, each for one of the pressure chambers 16. The piezoelectric actuator 9 applies pressure selectively to the ink in pressure chambers 16 to eject ink from them through the associated nozzles 20.

The vibration plate 30 is a stainless steel plate, which is substantially rectangular in plan view. The vibration plate 30 is disposed on and is joined to the upper surface of the cavity plate 10, closing the tops of the pressure chambers 16. The vibration plate 30 serves also as a common electrode, which faces the individual electrodes 32 so that an electric field can act on the portion of the piezoelectric layer 31 which lies between each individual electrode 32 and the vibration plate 30.

The piezoelectric layer 31 is formed on the upper surface of the vibration plate 30 continuously over the pressure chambers 16. The principal component of the piezoelectric layer 31 is lead zirconate titanate (PZT), which is a ferroelectric solid solution of lead titanate and lead zirconate. The piezoelectric layer 31 may be formed by sticking, on the vibration plate 30, a piezoelectric sheet, which is produced by baking a green sheet of PZT. Alternatively, the piezoelectric layer 31 may be formed by depositing PZT particles on the vibration plate 30 by the aerosol deposition (AD) process, the sputtering process or another process.

The individual electrodes 32 are formed on the upper surface of the piezoelectric layer 31, each positioned to overlap with a central portion of the associated pressure chamber 16 in a plan view. The individual electrodes 32 are smaller in size than the pressure chambers 16 to some extent in a plan view. The individual electrodes 32 are formed of gold or another electrically conductive material by means of screen printing or the like. A terminal 35 is formed at one end (the right or left end in FIG. 3) of each individual electrode 32 on the upper surface of the piezoelectric layer 31. All the terminals 35 are connected electrically to a driver IC 37 (see FIG. 10) via a flexible printed wiring board or another flexible wiring member so that driving voltage can be supplied from the IC 37 selectively to individual electrodes 32 through the associated terminals 35.

A description will be provided below of how the piezoelectric actuator 9 discharges ink.

The vibration plate 30 as the common electrode is kept at ground potential. When driving voltage is supplied from the driver IC 37 selectively to individual electrodes 32, a potential difference is made between each of these electrodes, which lie on the upper side of the piezoelectric layer 31, and the vibration plate 30, which lies on the under side of the piezoelectric layer. The potential difference generates a vertical electric field through the portion of the piezoelectric layer 31 that lies between the individual electrode 32 and vibration plate 30. The electric field horizontally contracts a portion of the piezoelectric layer 31 that is positioned directly under the individual electrode 32. In other words, this portion contracts perpendicularly to the directions of polarization of the piezoelectric layer 31, which are vertical. The contraction deforms the portion of the vibration plate 30 that lies under the individual electrode 32 so as to project toward the associated pressure chamber 16. The deformation toward the pressure chamber 16 reduces the volume of the pressure chamber 16, thereby applying pressure on the ink therein. The pressure discharges ink through the nozzle 20 communicating with the pressure chamber 16.

As shown in FIGS. 7-9, there is a gap between each partition wall 21 and the vibration plate 30, which covers the pressure chambers 16. Accordingly, the partition walls 21 do not prevent the piezoelectric layer 31 and vibration plate 30 of the piezoelectric actuator 9 from deforming. As a result, the piezoelectric actuator 9 can efficiently apply pressure on the ink in the pressure chambers 16.

Figure 10:
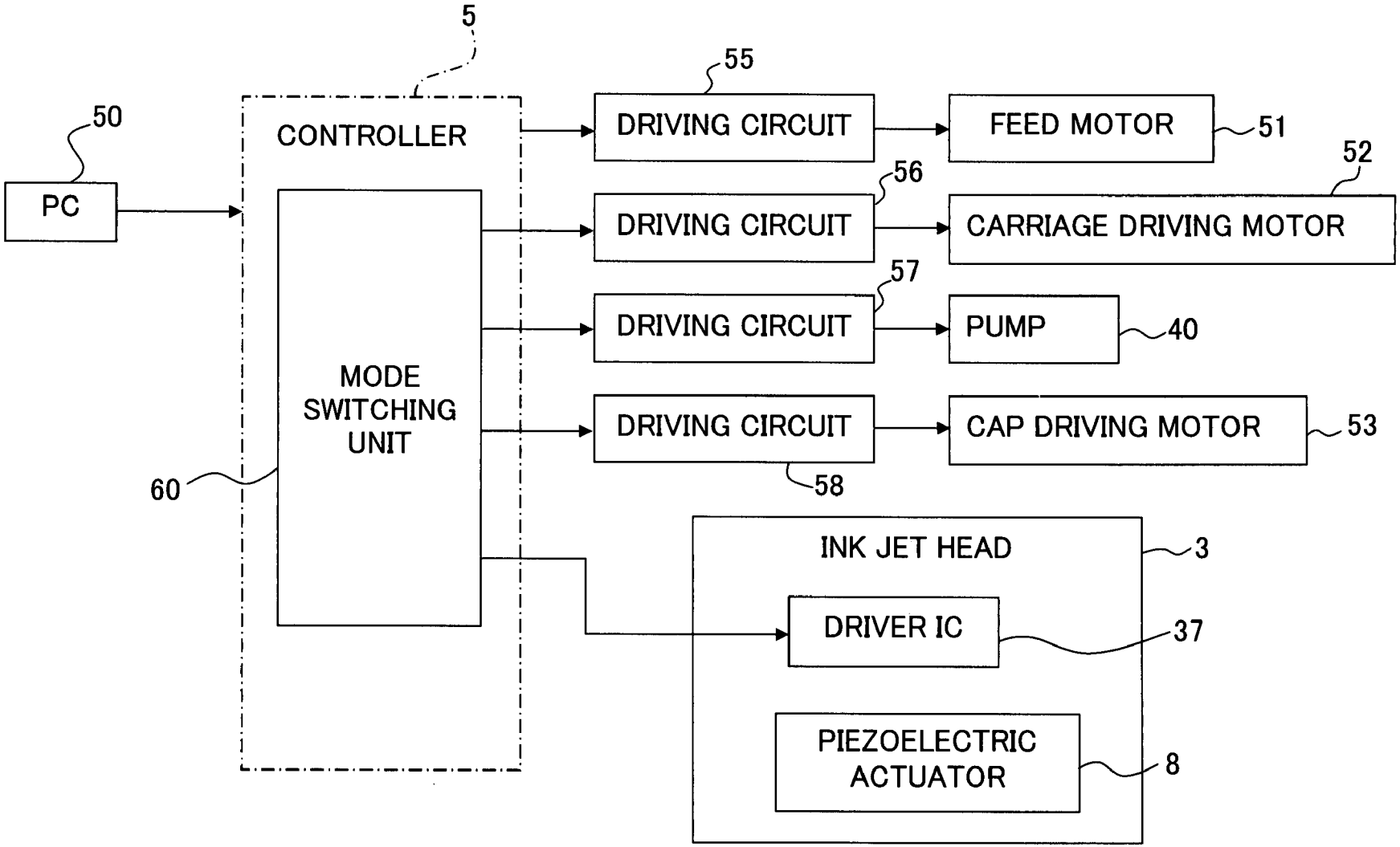
FIG. 10 is a block diagram showing the electric connection of the ink jet printer.

With reference to FIG. 10, which is a block diagram, explanation will be provided below of the controller 5 and the peripheral electric configuration of the ink jet printer 1.

The controller 5 includes a CPU (central processing unit), a ROM (read only memory), a RAM (random access memory), etc. The ROM stores the programs for controlling the overall operation of the ink jet printer 1, data, etc. The RAM temporarily stores the data processed by the CPU, etc.

As shown in FIG. 10, a PC (personal computer) 50 outputs print data etc. to the controller 5, which outputs various control signals to four driving circuits 55-58 and the driver IC 37 of the ink jet head 3. The driving circuits 55-58 activate a feed motor 51, a carriage driving motor 52, a pump 40 and a cap driving motor 53, respectively. The feed motor 51 rotates the feed rollers 4 (FIG. 1). The carriage driving motor 52 drives the carriage 2. The cap driving motor 53 serves to put the cap 41 (FIG. 2) on the ink jet head 3.

The controller 5 includes a mode switching section (mode switching unit) 60 for switching between an ink ejection mode and an ink circulation mode. In the ink ejection mode, ink is supplied from the ink tank 6 through the first and second ink channels 45*a* and 45*b* (FIG. 2) to the pressure chambers 16, and ink can be ejected from the nozzles 20. In the ink circulation mode, the pump 40 pressurizes the ink in the first ink channel 45*a* to circulate ink between the ink tank 6 and each pressure chamber 16. The mode switching section 60 maintains the ink ejection mode while the ink jet printer 1 is in normal condition for recording on recording paper P. The mode switching section 60 switches the modes to the ink circulation mode if the PC 50 outputs to the controller 5 a maintenance operation command to discharge the air bubbles mixed in the ink jet head 3.

Figure 11:
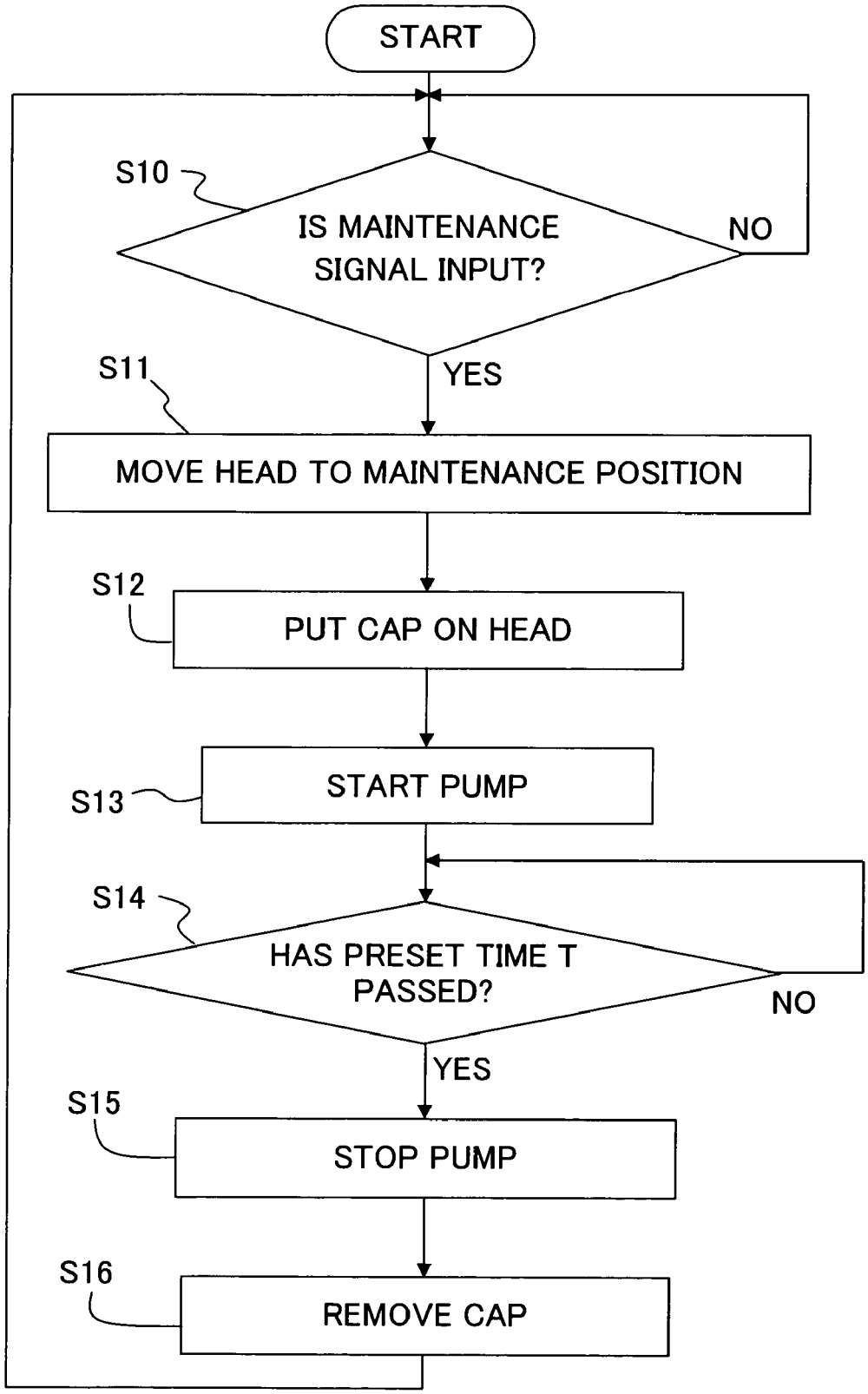
FIG. 11 is a flowchart of the mode switching process performed for the ink jet printer.
Figure 12:
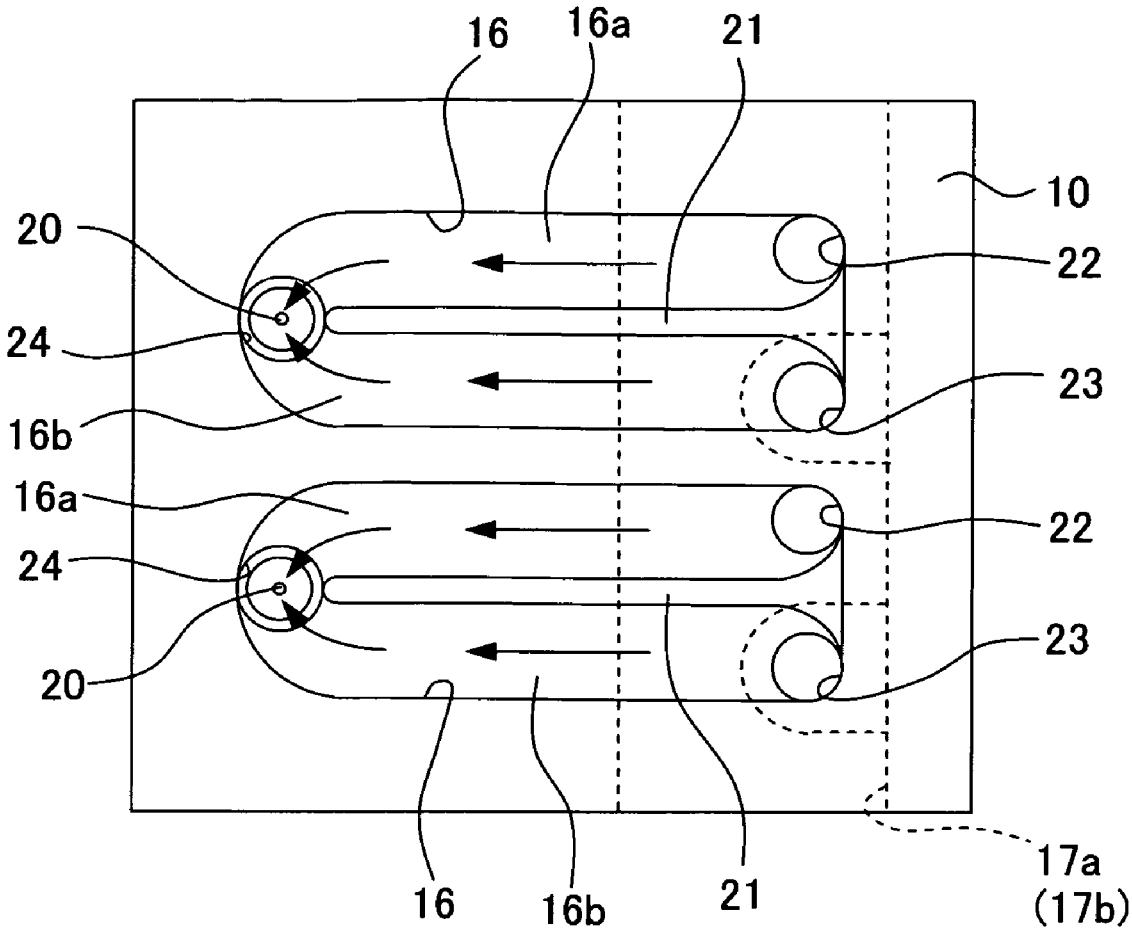
FIG. 12 is a view showing the ink flow through the pressure chambers of the ink jet printer in an ink ejection mode.

With reference to FIG. 11, which is a flowchart, an explanation will be provided below of the mode switching process performed by the mode switching section 60. In the following description, Si (i=10 to 16) represent steps 10-16, respectively. The mode switching process is performed at the same time that the ink jet printer 1 is supplied with electric power. In the ink ejection mode, which is maintained while the ink jet printer 1 is in normal condition, the pump 40 is not operating but open. In this mode, as indicated by solid arrows in FIGS. 2 and 12, ink is supplied through the two ink channels 45*a* and 45*b* to the pressure chambers 16, and the piezoelectric actuator 9 applies pressure to the ink in the pressure chambers 16 to eject ink through the nozzles 20.

In the ink ejection mode, when a signal commanding a maintenance operation is input from the PC 50 (yes at S10), the carriage driving motor 52 moves the ink jet head 3 to the maintenance position (S11), where the bottom surface of the head 3 does not face recording paper P, and where no recording is made on recording paper P. Subsequently, the cap driving motor 53 is operated to put the cap 41 on the bottom surface of the head 3 (S12).

Subsequently, the modes are switched to the ink circulation mode, in which the pump 40 is started up (S13) to circulate ink between the ink tank 6 and each pressure chamber 16 through the ink channels 45*a* and 45*b*, as shown by the dashed arrows in FIG. 2. As explained above, each pressure chamber 16 is partitioned into a first space 16*a* and a second space 16*b* by a partition wall 21, except for the portion of the chamber 16 that adjoins the associated communicating hole 24, which communicates with the associated nozzle 20. The first and second spaces 16*a* and 16*b* in the pressure chamber communicate with the ink channels 45*a* and 45*b*, respectively. The ink pressurized in the first ink channel 45*a* by the pump 40 flows through the communicating holes 22 into the first spaces 16*a* of the pressure chambers 16. As shown by the dashed arrows in FIG. 13, the ink flowing into each first space 16*a* is liable to turn around into the associated second space 16*b* and flow out through the associated communicating hole 23 to the second ink channel 45*b*. This results in a smaller or decreased amount of ink flowing from each pressure chamber 16 toward the associated nozzle 20. In the ink circulation mode, the pump 40 forces ink to circulate, so that the ink flow rate in the first and second individual ink channels 42*a* and 42*b* in the ink jet head 3 is sufficiently higher than that in the ink ejection mode. As a result, the air bubbles remaining in the individual ink channels 42*a* and 42*b* are forced reliably into the ink tank 6 by the circulating ink flow. The air bubbles are then discharged from the ink tank 6.

Figure 13:
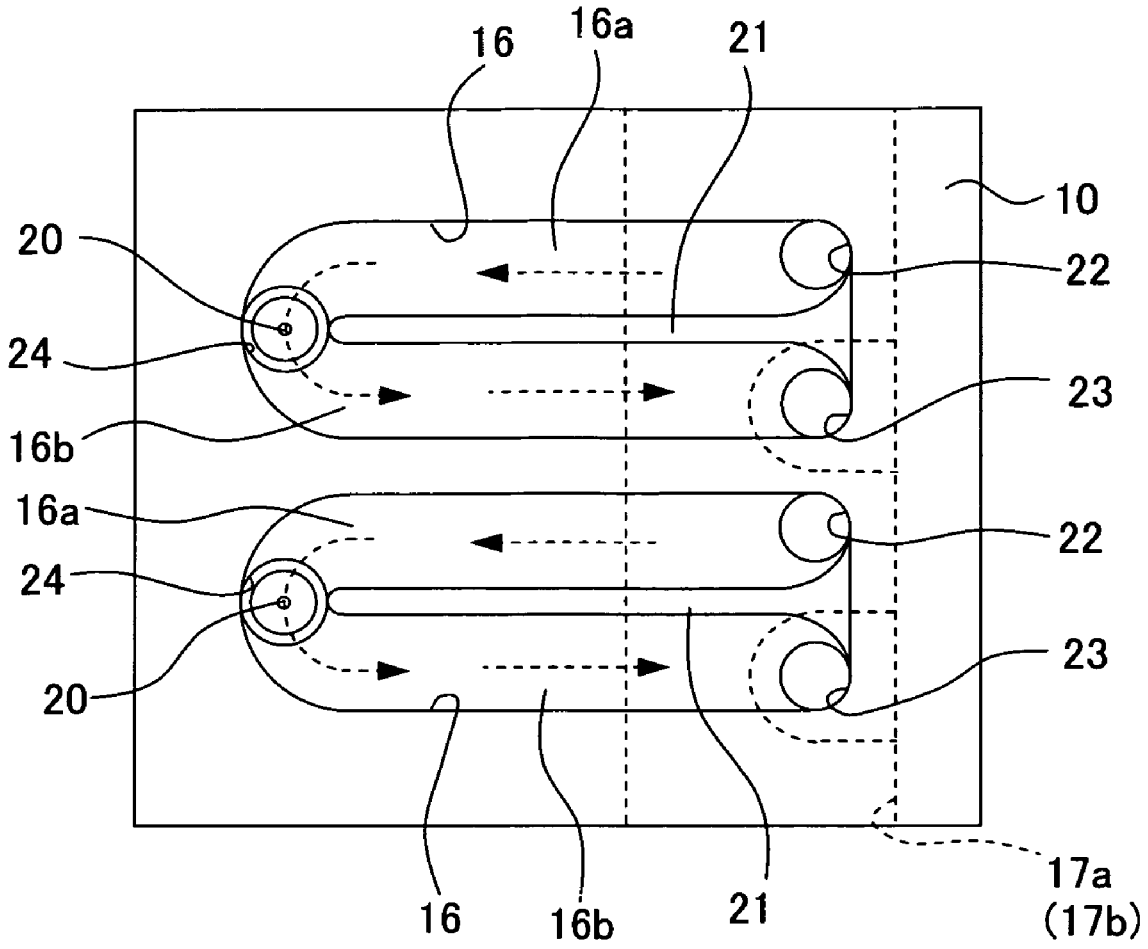
FIG. 13 is a view showing the ink flow in the pressure chambers in an ink circulation mode.

As shown in FIG. 13, each pressure chamber 16 is partitioned into two spaces 16*a* and 16*b* by the associated partition wall 21, which extends right and left, except for the portion of the chamber 16 that adjoins the associated communicating hole 24. This forces ink to flow from the communicating hole 22 at the right end of each pressure chamber 16 in FIG. 13 along the edges of the chamber 16, turn around near the associated communicating hole 24 at the left end of the chamber 16 and flow into the associated communicating hole 23 at the right end. This makes it possible to reliably discharge the air bubbles remaining along the edges of the pressure chambers 16. In the ink circulation mode, part of the ink pressurized by the pump 40 flows from each pressure chamber 16 through the associated communicating hole 24 to the associated nozzle 20, and small amounts of ink may be ejected through the nozzles 20. The ejected ink is received by the cap 41.

After the air bubbles are thus discharged by circulating the ink for a preset time T (yes at S14), the pump 40 is stopped (S15). Subsequently, the cap 41 is removed from the ink jet head 3 (S16). Subsequently, the modes are switched to the ink ejection mode, in which ink can be ejected again through the nozzles 20.

The ink jet printer 1 achieves the following effects. When it is necessary to discharge the air bubbles mixed in the ink jet head 3, the modes are switched from the ink ejection mode to the ink circulation mode, in which ink is circulated between the ink tank 6 and each pressure chamber 16. This makes it possible to discharge air bubbles reliably and reduce the amount of ink ejected through the nozzles 20 during a maintenance operation (air bubble discharging operation).

Each pressure chamber 16 is partitioned into two spaces 16*a* and 16*b* by the associated partition wall 21, except for the portion of the chamber 16 that adjoins the associated communicating hole 24, which communicates with the associated nozzle 20. The first and second spaces 16*a* and 16*b* communicate with the ink channels 45*a* and 45*b*, respectively. Accordingly, in the ink circulation mode, the ink pressurized in the first ink channel 45*a* by the pump 40 and flowing through the communicating holes 22 into the pressure chambers 16 is liable to flow out through the communicating holes 23 to the second ink channel 45*b*. This results in smaller amounts of ink being ejected through the nozzles 20 during a maintenance operation.

Figure 14:
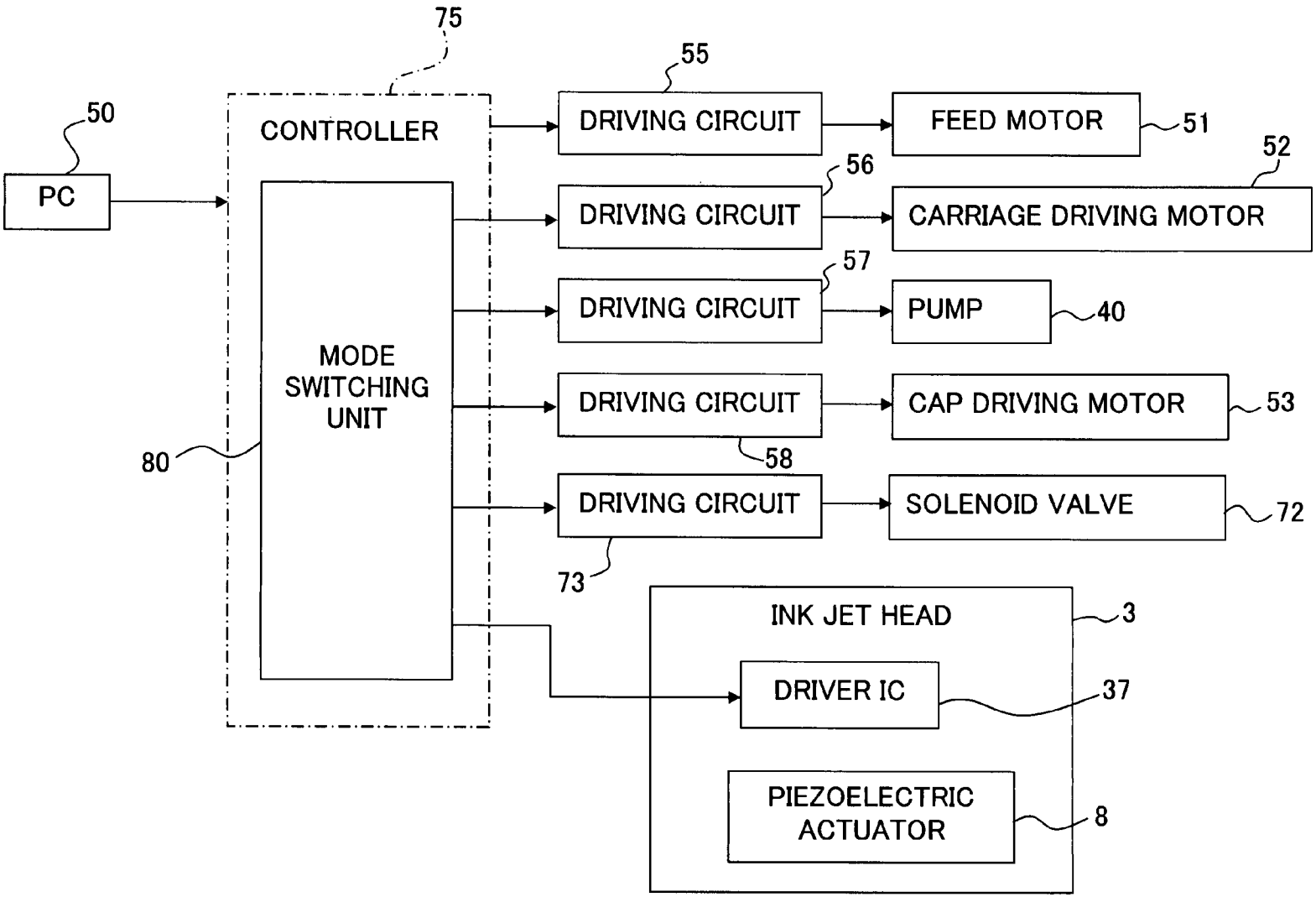
FIG. 14 is a block diagram showing the electric connection of an ink jet printer according to a second embodiment of the present invention.
Figure 15:
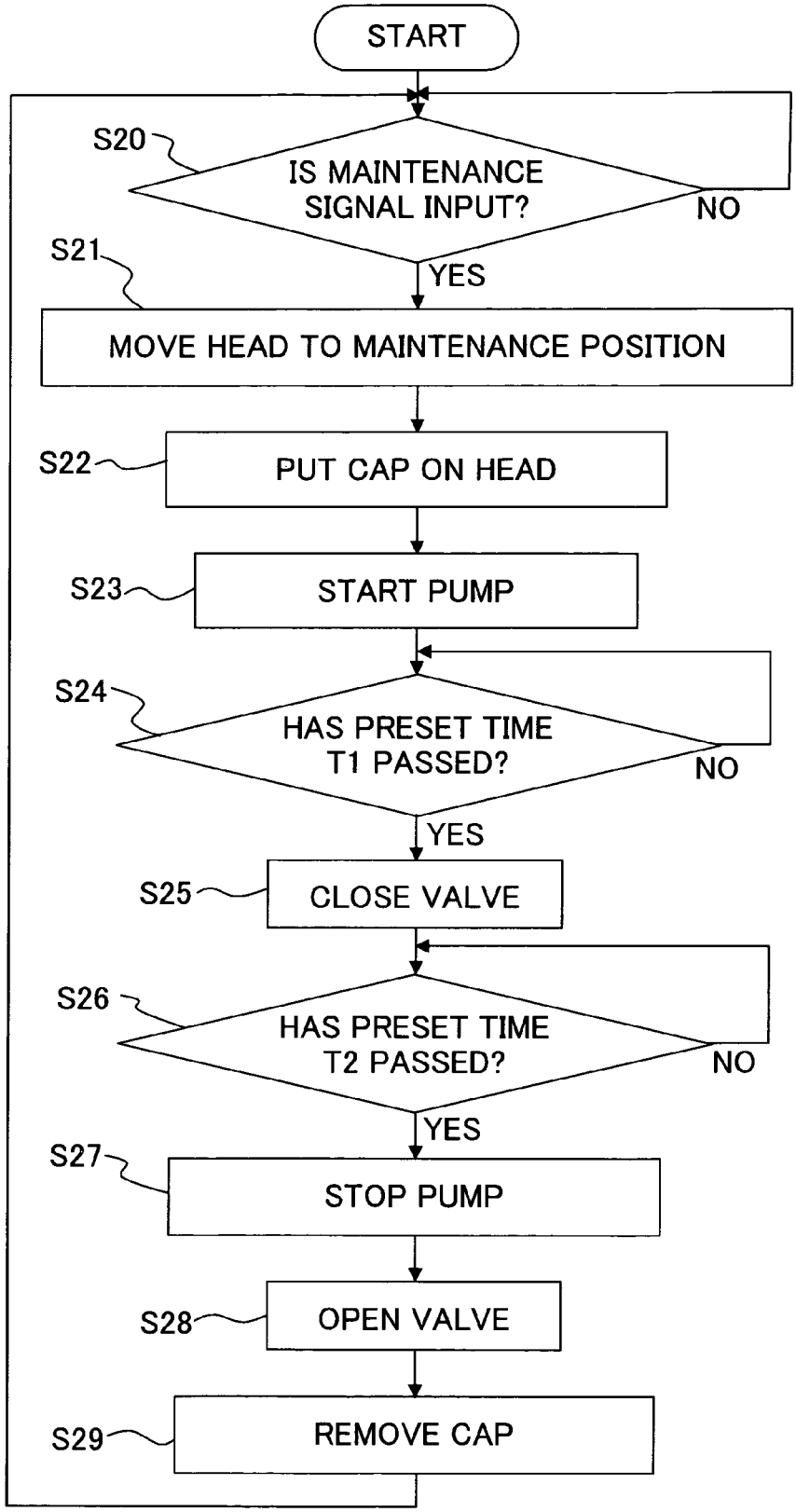
FIG. 15 is a flowchart of the mode switching process performed for this printer.
Figure 16:
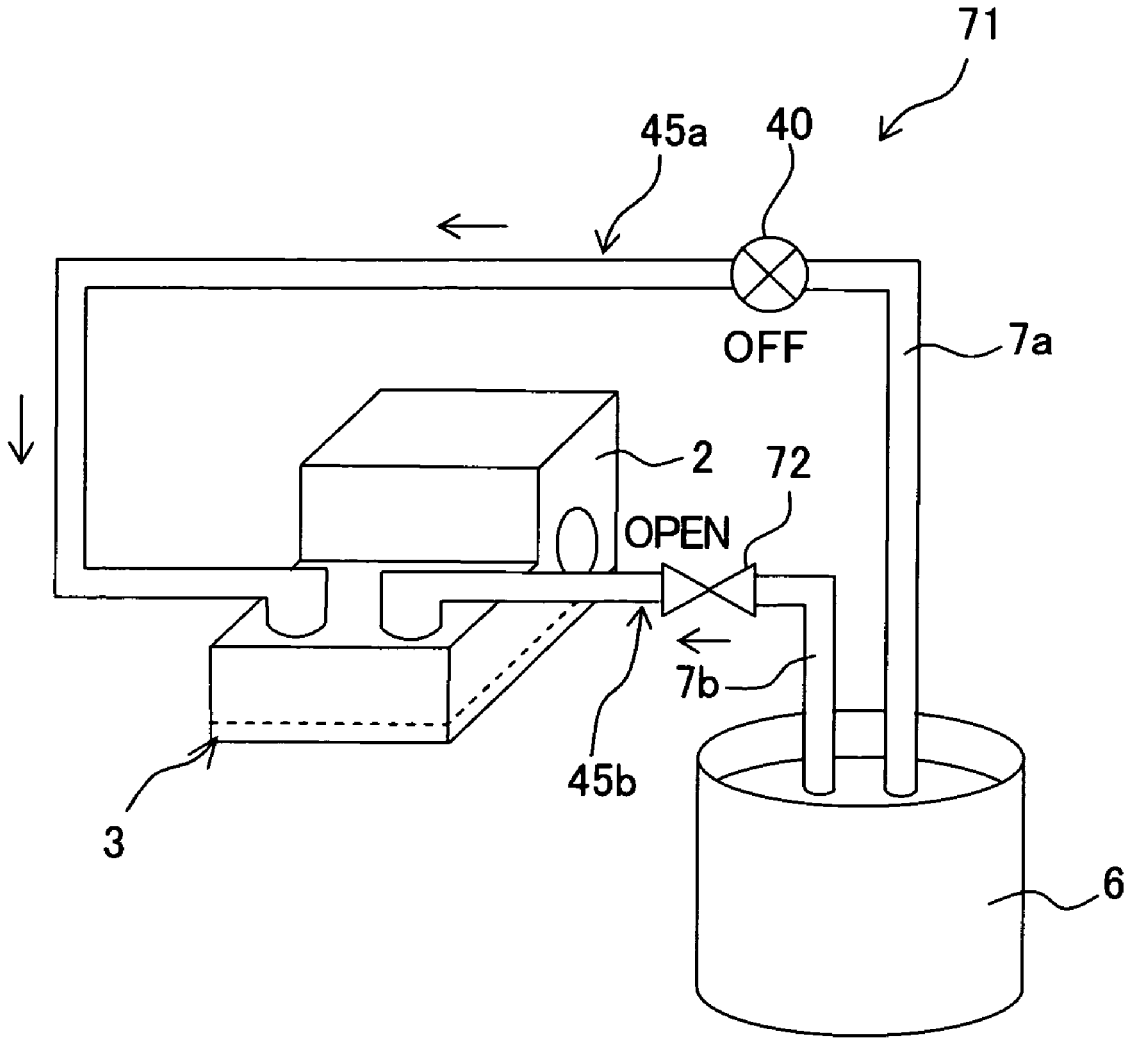
FIG. 16 is a view showing the ink flow in this printer in an ink ejection mode.
Figure 17:
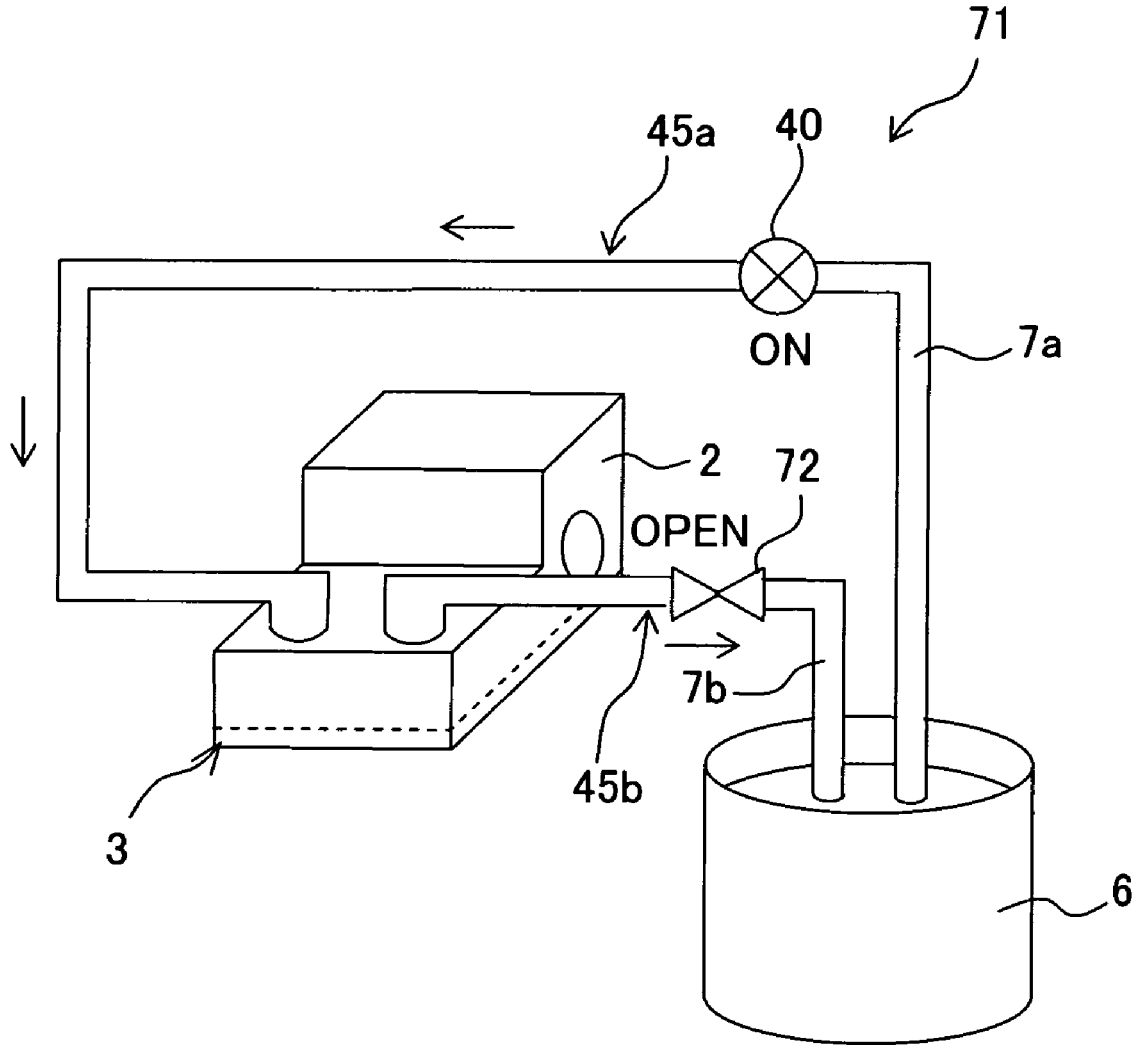
FIG. 17 is a view showing the ink flow in this printer in an ink circulation mode.
Figure 18:
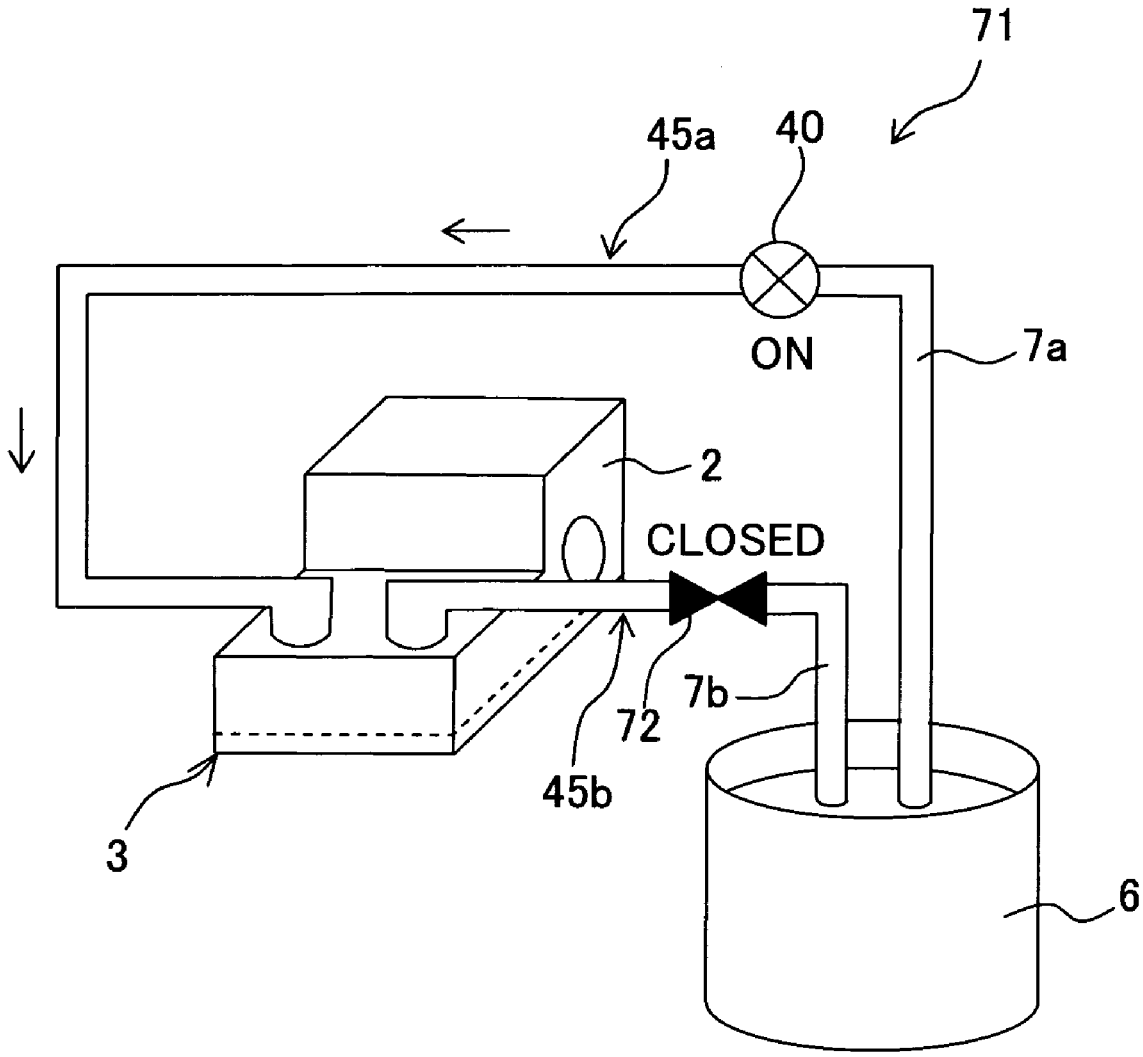
FIG. 18 is a view showing the ink flow in this printer in a nozzle cleaning mode.

A second embodiment of the present invention will be described below with reference to FIGS. 14-18. The components of this embodiment that are similar in structure to the counterparts in the first embodiment are assigned the same reference numerals, and some of the similar components will not be explained. In an ink jet printer 71 according to this embodiment, as is the case with the first embodiment, the ink jet head 3 and ink tank 6 are connected by the two ink channels 45*a* and 45*b*. As shown in FIGS. 16-18, however, the tube 7*b* constructing a part of the second ink channel 45*b* is provided with a solenoid valve 72. As shown in FIG. 14, a controller 75 outputs control signals to a driving circuit 73 to open and close the solenoid valve 72.

The mode switching unit 80 of the controller 75 can switch the modes to a nozzle cleaning mode in addition to the ink ejection mode and the ink circulation mode. In the nozzle cleaning mode, with the solenoid valve 72 closed, the pump 40 pressurizes the ink in the first ink channel 45*a* to eject ink through the nozzles 20.

Mainly with reference to FIG. 15, which is a flowchart, a description will be provided below of the mode switching process performed by the mode switching unit 80 of the second embodiment. In the ink ejection mode, the pump 40 is not operating, and the solenoid valve 72 is open. In this mode, as shown in FIG. 16, ink is supplied through the two ink channels 45*a* and 45*b* to the pressure chambers 16, and the piezoelectric actuator 9 applies pressure to the ink in the chambers 16 to eject the ink through the nozzles 20.

With the ink jet printer 71 in the condition shown in FIG. 16, when a maintenance signal is input from the PC 50 (yes at S20), the ink jet head 3 is moved to the maintenance position (S21), as is the case with the first embodiment. Subsequently, the cap 41 is put on the bottom surface of the ink jet head 3 (S22). Subsequently, the modes are switched to the ink circulation mode, in which the pump 40 is started up (S23) to circulate ink between the ink tank 6 and each pressure chamber 16 through the ink channels 45*a* and 45*b*, as shown in FIG. 17. After the air bubbles in the ink jet head 3 are discharged by circulating the ink for a preset time T1 (yes at S24), the solenoid valve 72 is closed (S25). The ink pressurized in the first ink channel 45*a* by the pump 40 flows into the pressure chambers 16. Because the solenoid valve 72 of the second ink channel 45*b* is closed, the ink flowing into the pressure chambers 16 is ejected with great force through the nozzles 20 (the nozzle cleaning mode). This makes it possible to discharge through the nozzles 20 the air bubbles remaining in the communicating holes 24 and 27-29 from the pressure chambers 16 to the nozzles 20. This also makes it possible to eliminate the clogging of the nozzles 20.

In the ink circulation mode, the air bubbles remaining in the ink channels upstream from the pressure chambers 16 are discharged. Subsequently, the modes are switched to the nozzle cleaning mode, in which the air bubbles between each pressure chamber 16 and the associated nozzle 20 are removed. This makes it possible to reduce the amount of ink ejected to discharge the air bubbles remaining between each pressure chamber 16 and the associated nozzle 20.

After ink is ejected through the nozzles 20 for a preset time T2 (yes at S26), the pump 40 is stopped (S27). Subsequently, the solenoid valve 72 is opened (S28). Subsequently, the cap 41 is removed from the ink jet head 3 (S29). Subsequently, the modes are switched to the ink ejection mode, in which ink can be ejected again through the nozzles 20.

After the mode switching unit 80 of this embodiment switches the modes from the ink ejection mode to the ink circulation mode, it further switches the modes to the nozzle cleaning mode. However, for example, for a maintenance operation for the main purpose of eliminating the clogging of the nozzles 20, the mode switching unit 80 could switch the modes from the ink ejection mode directly to the nozzle cleaning mode, without switching the modes to the ink circulation mode.

Modifications of the two embodiments will be described below.

First Modified Embodiment

Figure 19:
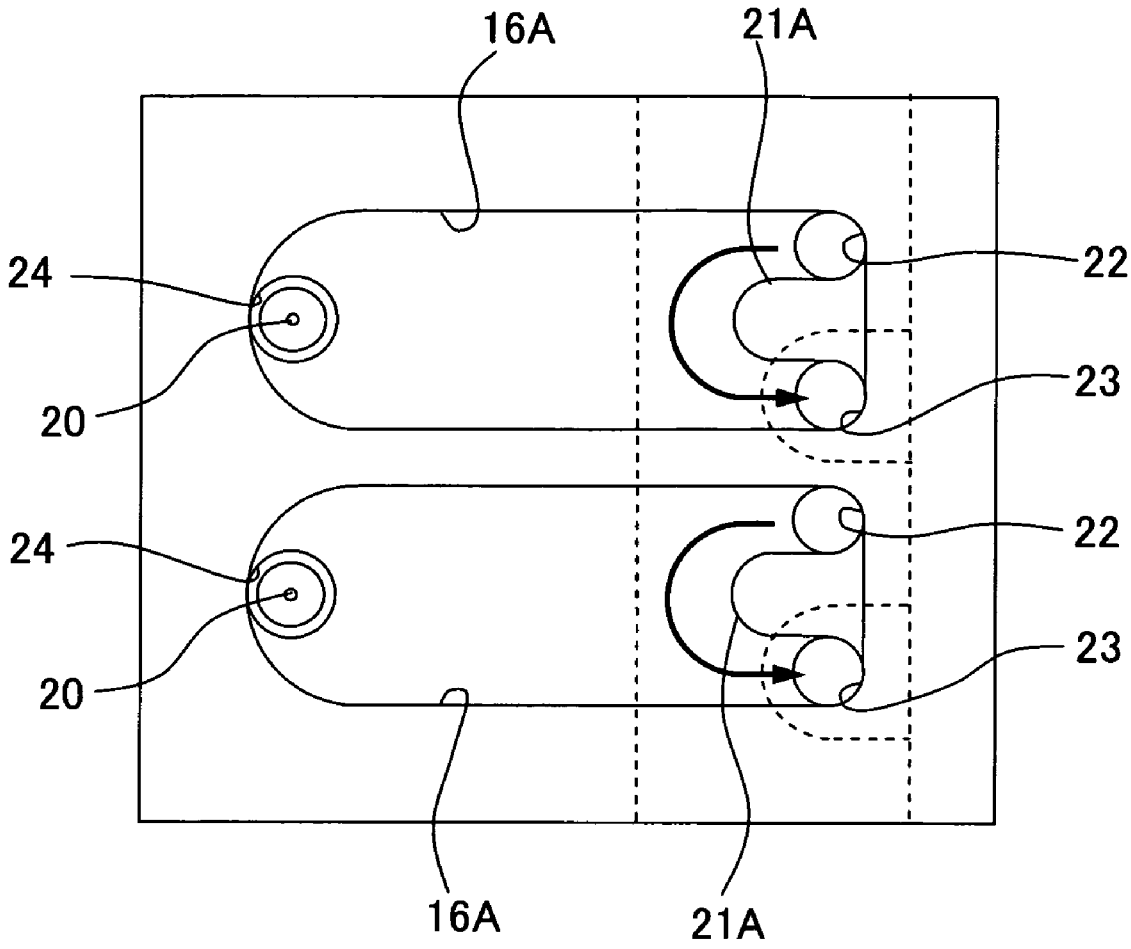
FIG. 19 is an enlarged plan view of part of the channel unit of an ink jet printer according to a modified embodiment of the present invention.

The partition wall 21 (FIG. 5) in each pressure chamber 16 is a guide that forces the ink, flowing from the communicating hole 22 of the associated first individual ink channel 42*a* into the chamber 16, to flow out through the communicating hole 23 of the associated second individual ink channel 42*b* to the second ink channel 45*b*. The guide needs not be limited to the partition wall 21, which partitions the pressure chamber 16 into two spaces. For example, FIG. 19 shows another ink jet head having pressure chambers 16A, in each of which a guide 21A is formed between the associated communicating holes 22 and 23 and extends slightly toward the associated nozzle 20 in plan view. The ink flowing from the communicating hole 22 into the pressure chamber 16 can be guided to the communicating hole 23 by the guide 21A.

Second Modified Embodiment

In each of the embodiments, the pump 40 applies positive pressure to the liquid in the tube 7*a*. In place of, or in addition to the pump 40, the other tube 7*b* can be provided with a pump for bringing negative pressure. The pump 40 may be a tube pump or any other pump that can bring positive or negative pressure to liquid.

Third Modified Embodiment

The ink jet printer according to each of the embodiments switches the modes from the ink ejection mode to the ink circulation mode when a maintenance signal is input from the associated PC50. However, the modes may be switched at another timing, for example, when the ink jet printer is switched on, or when a user enters a maintenance signal from the operating section of the printer.

Fourth Modified Embodiment

The ink jet printer according to each of the embodiments is a serial ink jet printer. The present invention may also be applied to a line ink jet printer, which is long widthwise of recording paper P.

Fifth Modified Embodiment

The present invention may further be applied to other liquid ejection apparatuses that eject liquid other than ink. One of the ejection apparatuses ejects a conductive paste to form a wiring pattern on a board. Another of the ejection apparatuses ejects an organic emitter onto a board to form an organic electroluminescent display. Another of the ejection apparatuses ejects an optical resin onto a board to form an optical (fiber) waveguide or another optical device. When the liquid ejection apparatus according to the present invention is used for one of the foregoing purposes, it may not be provided with a liquid supply source. In this case, it is possible to use a liquid storage tank or other equipment existing at the place where the liquid ejection apparatus is used. As a liquid storage tank, an interchangeable cartridge available on the market separately from the liquid ejection apparatus may be used.

The ink jet printer according to each of the embodiments has a number of nozzles and pressure chambers, each of which is associated with one of the nozzles. However, the present invention can also be applied to liquid ejection apparatuses as described above but having a single nozzle and a single pressure chamber. Such liquid ejection apparatuses are within the scope of the present invention.

What is claimed is:

1. A liquid ejection apparatus which ejects a liquid supplied from a liquid supply source, comprising:

a liquid ejection head comprising a plurality of nozzles through which the liquid is ejected;

a plurality of pressure chambers each communicating with one of the nozzles;

an actuator which applies pressure selectively to liquid in the pressure chambers to eject the liquid through the nozzles;

a first liquid channel and a second liquid channel independent of the first liquid channel such that the liquid cannot be transported therebetween outside of the liquid ejection head, the first and second liquid channels communicating the pressure chambers with the liquid supply source;

a pressure applying unit which applies pressure to liquid in the first liquid channel;

a mode switching unit which switches between two modes of a liquid ejection mode in which liquid is supplied from the liquid supply source through the first and second liquid channels to the pressure chambers to be ejected through the nozzles, and a liquid circulation mode in which the pressure applying unit applies pressure to the liquid in the first liquid channel to circulate the liquid between the liquid supply source and each of the pressure chambers;

guides, each of which is provided in one of the pressure chambers and which forces the liquid pressurized by the pressure applying unit and flowed from the first liquid channel into the pressure chambers to flow out of the pressure chambers to the second liquid channel; and communicating channels each communicating one of the pressure chambers and the associated nozzle together;

wherein the guides are partition walls each partitioning the associated pressure chamber into a first space and a second space, the first and second spaces communicating with the first and second liquid channels, respectively;

the first and second spaces of each of the pressure chambers are connected together only in the vicinity of the associated communicating channel; and the actuator changes a volume of each of the pressure chambers to apply pressure to the liquid in one of the pressure chambers, the actuator being arranged to cover the pressure chambers, and being spaced from the partition walls to form a gap between the actuator and the partition walls.

2. The liquid ejection apparatus according to claim 1 further comprising:

a valve capable of closing the second liquid channel;

the mode switching unit being switchable among the two modes and a nozzle cleaning mode in which, after the valve closes the second liquid channel, the pressure applying unit applies pressure to the liquid in the first liquid channel to eject the liquid through the nozzles.

3. The liquid ejection apparatus according to claim 2 wherein, after switching the modes from the liquid ejection mode to the liquid circulation mode, the mode switching unit further switches the modes to the nozzle cleaning mode.

4. The liquid ejection apparatus according to claim 1 wherein the actuator is a piezoelectric actuator including:

a vibration plate arranged to cover the pressure chambers, wherein the vibration plate is spaced from the partition walls to form a gap therebetween; and a piezoelectric layer disposed on a surface of the vibration plate which is opposite to the pressure chambers.

5. The liquid ejection apparatus according to claim 1 wherein each of the first and second liquid channels includes:

a common liquid chamber communicating with the pressure chambers; and individual channels each communicating with the common liquid chamber and one of the pressure chambers.

6. The liquid ejection apparatus according to claim 5, wherein the liquid ejection head further comprises the pressure chambers and the actuator; and wherein one of the common liquid chambers of the first and second liquid channels is positioned over the other of the common liquid chambers in the liquid ejection head.

7. The liquid ejection apparatus according to claim 1 further comprising the liquid supply source.

8. The liquid ejection apparatus according to claim 1 which is an ink jet printer, wherein the mode switching unit is a control unit of the liquid ejection apparatus.

9. The liquid ejection apparatus according to claim 1, wherein the pressure chambers are arranged in a plane in the liquid ejection head, and each of the partition walls extends in the plane to partition one of the pressure chambers into the first space and the second space.

* * * * *

UNITED STATES PATENT AND TRADEMARK OFFICE

CERTIFICATE OF CORRECTION

PATENT NO. : 7,604,327 B2
APPLICATION NO. : 11/232983
DATED : October 20, 2009
INVENTOR(S) : Hiroto Sugahara It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 658 days.

Signed and Sealed this

Fifth Day of October, 2010

David J. Kappos

David J. Kappos
*Director of the United States Patent and Trademark Office*